US008991990B2

(12) United States Patent
Tomoguchi et al.

(10) Patent No.: US 8,991,990 B2
(45) Date of Patent: Mar. 31, 2015

(54) LIQUID CARTRIDGE HAVING VALVE FOR OPENING AND CLOSING AIR FLOW PATH

(71) Applicants: Suguru Tomoguchi, Okazaki (JP); Tetsuro Kobayashi, Nagoya (JP)

(72) Inventors: Suguru Tomoguchi, Okazaki (JP); Tetsuro Kobayashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/218,003

(22) Filed: Mar. 18, 2014

(65) Prior Publication Data

US 2014/0292958 A1 Oct. 2, 2014

(30) Foreign Application Priority Data

Mar. 28, 2013 (JP) ..... 2013-069546
Mar. 28, 2013 (JP) ..... 2013-069557
Mar. 28, 2013 (JP) ..... 2013-069562

(51) Int. Cl.
*B41J 2/175* (2006.01)

(52) U.S. Cl.
CPC ..... *B41J 2/17503* (2013.01); *B41J 2/17523* (2013.01)
USPC ..... 347/86; 347/84

(58) Field of Classification Search
USPC ..... 347/7, 84, 85, 86
See application file for complete search history.

(56) References Cited

U.S. PATENT DOCUMENTS 6,170,939 B1 * 1/2001 Ujita et al. ..... 347/86
6,302,534 B1 10/2001 Tsukahara et al.
6,539,985 B2 4/2003 Shinada et al.
7,303,271 B2 * 12/2007 Shimizu et al. ..... 347/94
7,645,033 B2 * 1/2010 Bulman et al. ..... 347/86
8,177,343 B2 5/2012 Yoshiike
8,272,724 B2 * 9/2012 Kanbe ..... 347/86
2001/0050113 A1 12/2001 Shinada et al.
2001/0052370 A1 12/2001 Shinada et al.
2006/0000802 A1 1/2006 Kumar et al.
2007/0017898 A1 1/2007 Kumar et al.
2010/0194830 A1 8/2010 Yoshiike
2012/0188315 A1 7/2012 Kawate

FOREIGN PATENT DOCUMENTS

JP 2000-238283 A 9/2000
JP 2005-111922 A 4/2005

(Continued)

OTHER PUBLICATIONS

Co-pending U.S. Appl. No. 14/217,965, filed Mar. 18, 2014.

*Primary Examiner* — Anh T. N. Vo
(74) *Attorney, Agent, or Firm* — Banner & Witcoff, Ltd.

(57) ABSTRACT

A liquid cartridge includes: a cartridge body defining a liquid chamber therein; a liquid supply portion provided at the cartridge body; an air flow path provided in the cartridge body; and a valve configured to open and close the air flow path. The air flow path is in communication with the liquid chamber through a communication hole and in communication with ambient air to permit communication between the liquid chamber and ambient air through the air flow path. The valve includes: a slidable valve main body disposed in an internal space defined by an inner peripheral wall of the air flow path; and a sealing member provided on the valve main body, the sealing member including a first elastic portion configured to seal the communication hole and a second elastic portion configured to be in contact with and in sliding contact with the inner peripheral wall.

19 Claims, 12 Drawing Sheets

(56) References Cited

FOREIGN PATENT DOCUMENTS

| | | | |
|---|---|---|---|
| JP | 2005-161641 | A | 6/2005 |
| JP | 2009-096126 | A | 5/2009 |
| JP | 2010-221477 | A | 10/2010 |
| JP | 2011-071527 | A | 4/2011 |
| JP | 2012-152998 | A | 8/2012 |
| WO | 00/58100 | A1 | 10/2000 |

* cited by examiner

LIQUID CARTRIDGE HAVING VALVE FOR OPENING AND CLOSING AIR FLOW PATH

CROSS REFERENCE TO RELATED APPLICATION

This application claims priority from Japanese Patent Application Nos. 2013-069546 filed Mar. 28, 2013, 2013-069557 filed Mar. 28, 2013 and 2013-069562 filed Mar. 28, 2013. The entire contents of these priority applications are incorporated herein by reference.

TECHNICAL FIELD

The present invention relates to a liquid cartridge provided with a liquid chamber and an air flow path configured to permit the liquid chamber to communicate with ambient air to bring pressure of the liquid chamber into atmospheric pressure.

BACKGROUND

There is known an image recording apparatus that uses ink to record an image onto a recording sheet. This image recording apparatus includes an inkjet type recording head and is configured to selectively spray ink droplets from the recording head toward a recording sheet. The ink droplets are landed onto the recording sheet, thereby a desired image being recorded on the recording sheet. The image recording apparatus can accommodate an ink cartridge having an ink chamber that stores ink to be supplied to the recording head. The ink cartridge is detachably received in an accommodating portion provided in the image recording apparatus.

The ink cartridge to be accommodated in the image recording apparatus is internally sealed, before use, so as to prevent ink stored in the ink chamber from leaking outside. The ink chamber is brought into atmospheric pressure when used. To this end, the ink cartridge is provided with an air flow path through which the ink chamber is permitted to communicate with ambient air. Conventionally, a valve mechanism has been provided in the air flow path for opening and closing the same, for example. Japanese Patent Application Publication Nos. 2005-161641 and 2005-111922 disclose such a conventional valve system provided in the ink cartridge.

SUMMARY

Conceivably, various valve mechanisms can be provided in the air flow path for preventing ink leakage therefrom and for achieving enhanced operability to open and close the air flow path. In any event, it is preferable that such valve mechanism be simple and compact.

In view of the foregoing, it is an object of the present invention to provide a simple and compact valve structure for opening and closing an air flow path provided in an ink cartridge.

In order to attain the above and other objects, the present invention provides a liquid cartridge including a cartridge body, a liquid supply portion provided at the cartridge body, an air flow path provided in the cartridge body, and a valve configured to open and close the air flow path. The cartridge body defines a liquid chamber therein for storing liquid. The liquid supply portion is configured to supply the liquid stored in the liquid chamber to outside. The air flow path is configured to be in communication with the liquid chamber through a communication hole and in communication with ambient air to permit the liquid chamber to communicate with ambient air through the air flow path, the air flow path having an inner peripheral wall defining an internal space therein. The valve includes a valve main body and a sealing member provided on the valve main body. The valve main body is disposed in the internal space and slidable in a sliding direction. The sealing member includes: a first elastic portion configured to seal the communication hole; and a second elastic portion configured to be in contact with and in sliding contact with the inner peripheral wall.

DETAILED DESCRIPTION

1. Overall Structure of Printer

Figure 1:
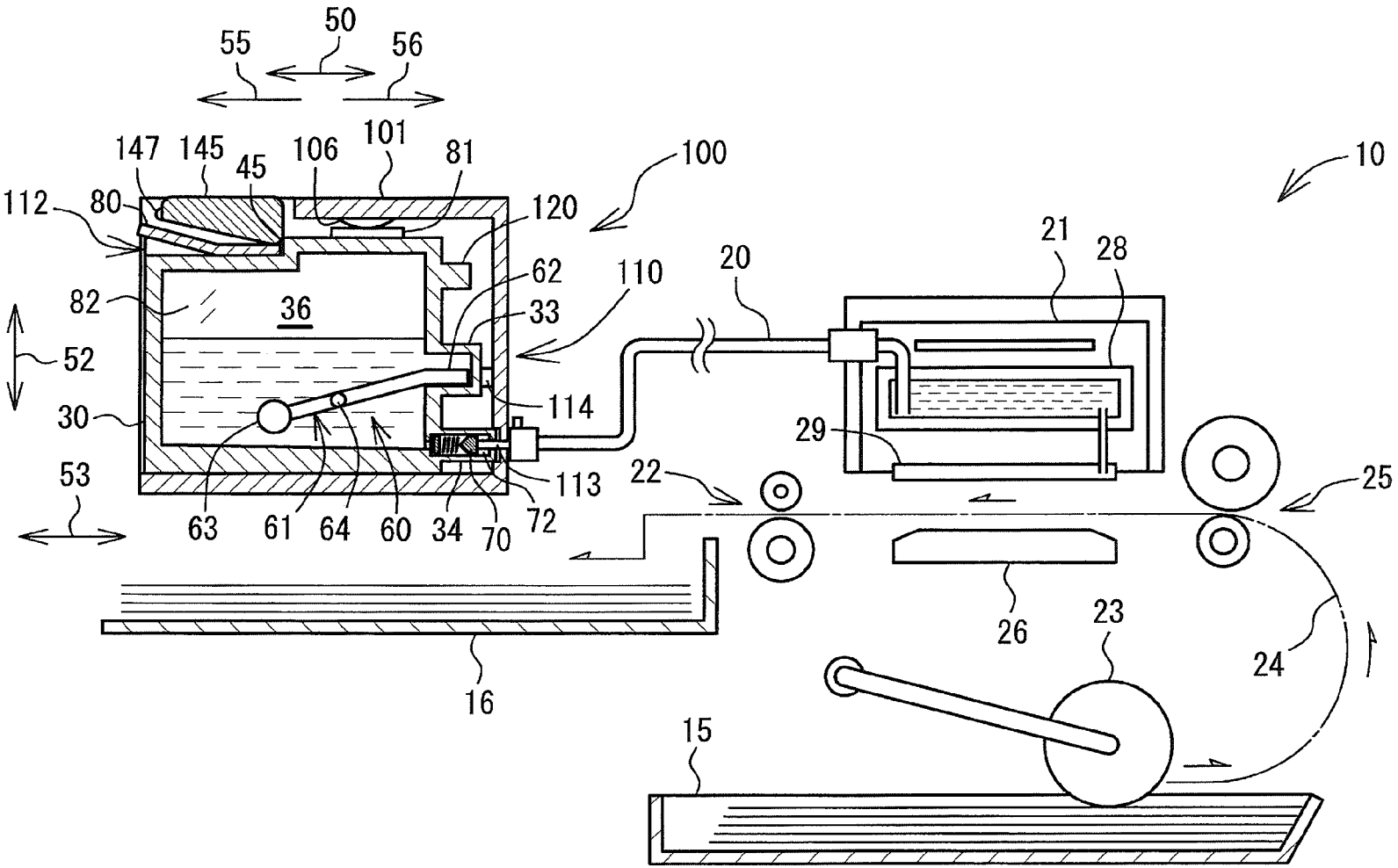
FIG. 1 is a conceptual cross-sectional view showing an internal construction of a printer provided with an cartridge accommodating section that detachably accommodates an ink cartridge according to an embodiment of the present invention.

First, a printer 10 adapted to accommodate the ink cartridge 30 according to an embodiment of the present invention will be described with reference to FIG. 1.

The printer 10 is configured to form an image by ejecting ink droplets onto a sheet in accordance with an ink jet recording system. As shown in FIG. 1, the printer 10 includes an ink supply device 100 provided with a cartridge accommodating section 110 configured to detachably accommodate the ink cartridge 30 therein. The printer 10 also includes a recording head 21 and ink tubes 21 connecting the ink supplying device 100 and the recording head 21.

The cartridge accommodating section 110 has one side formed with an opening 112 exposed to an atmosphere. The ink cartridge 30 can be inserted into and removed from the cartridge accommodating section 110 through the opening 112.

The ink cartridge 30 stores therein an ink to be used in the printer 10. The ink cartridge 30 is connected to the recording head 21 through the corresponding ink tube 20 when the ink cartridge 30 is mounted in the cartridge accommodating section 110. The recording head 21 has a sub tank 28 in which the ink supplied from the ink cartridge 30 through the ink tube 20 is temporarily stored. The recording head 21 also includes a plurality of nozzles 29 through which ink supplied from the sub tank 28 is selectively ejected in accordance with the ink jet recording system.

The printer 10 also includes a sheet supply tray 15, a sheet supply roller 23, a sheet path 24, a pair of transfer rollers 25, a platen 26, a pair of discharge rollers 22, and a discharge tray 16. A sheet of paper is supplied from the sheet supply tray 15 to the sheet passage 24 by the sheet supply roller 23, and is then conveyed to the platen 26 by the pair of transfer rollers 25. Then, the ink is selectively ejected from the recording head 21 onto the sheet passing through the platen 26 to form an inked image on the sheet. The sheet is then discharged onto the discharge tray 16 by the pair of discharge rollers 22.

2. Ink Supply Device

The ink supply device 100 functions to supply ink to the recording head 21, as shown in FIG. 1. As described above, the ink supply device 100 includes the cartridge accommodating section 110 in which the ink cartridge 30 is detachable loadable.

FIG. 1 shows a state where the ink cartridge 30 has been loaded in the cartridge accommodating section 110. In the printer 10 of the present embodiment, the cartridge accommodating section 110 is configured to accommodate four kinds of ink cartridges 30 corresponding to four colors of cyan, magenta, yellow and black, respectively. However, for explanatory purpose, FIG. 1 depicts the cartridge accommodating section 110 that has accommodated only one ink cartridge 30 therein.

Figure 2:
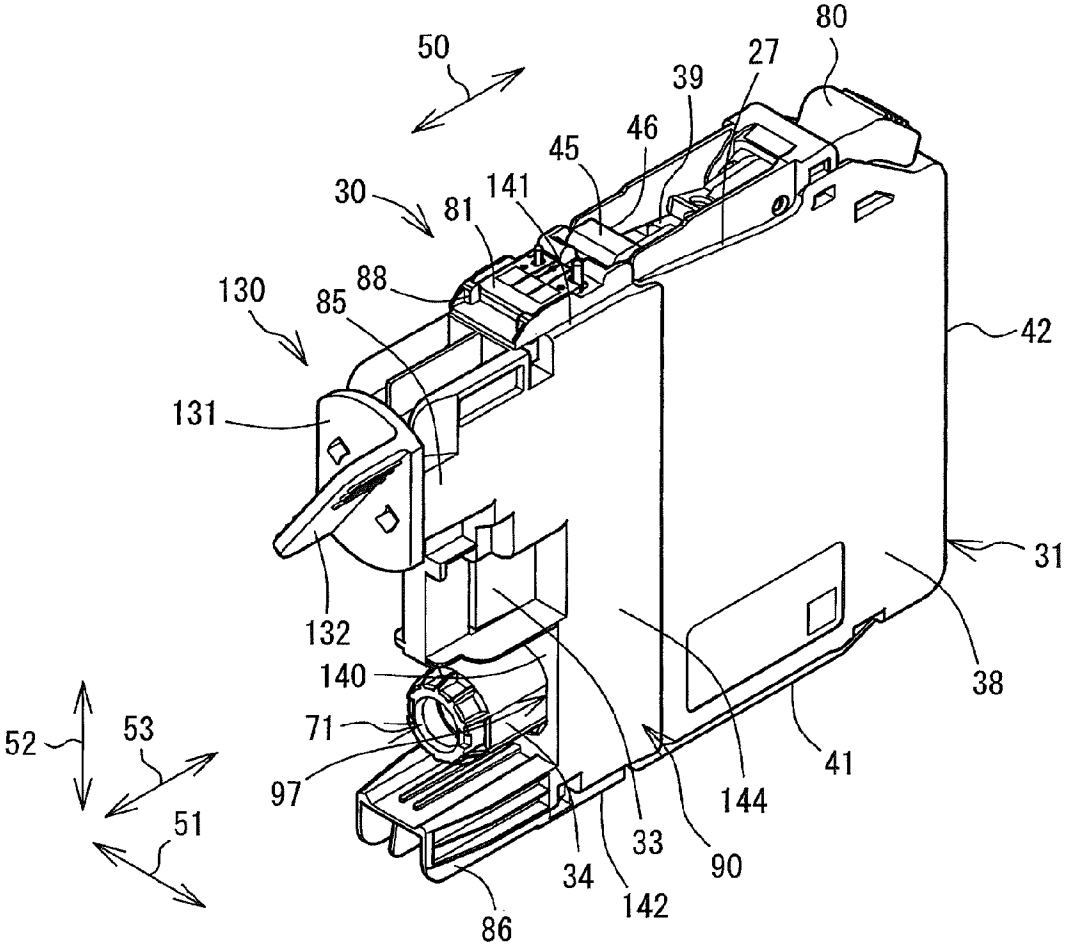
FIG. 2 is a perspective view showing an external appearance of the ink cartridge according to the embodiment, wherein a release member is assembled to the ink cartridge.
Figure 3:
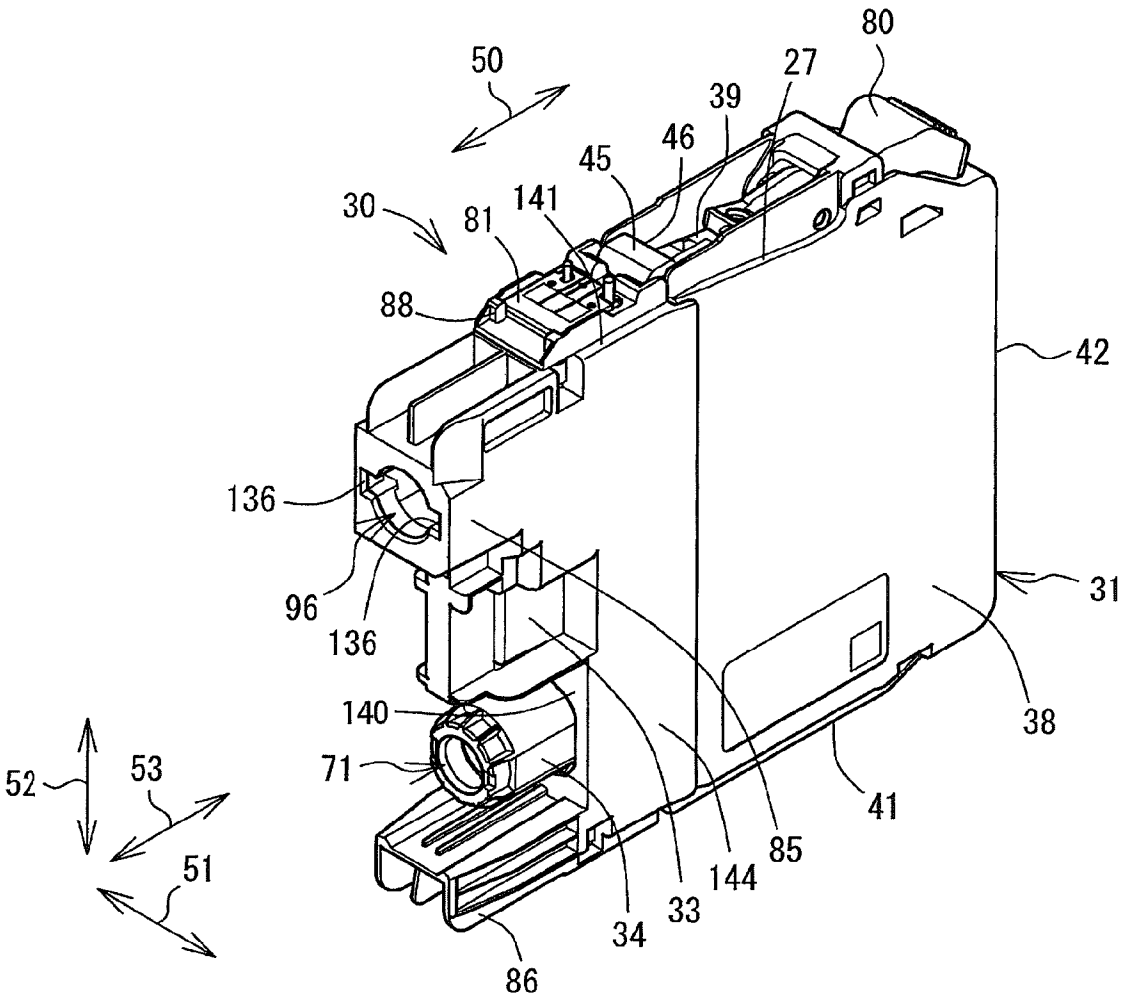
FIG. 3 is a perspective view showing the external appearance of the ink cartridge according to the embodiment, wherein the release member has been removed from the ink cartridge.

The ink cartridge 30 is mounted in and removed from the cartridge accommodating section 110 in an upstanding posture shown in FIGS. 2 to 3. Specifically, the ink cartridge 30 is loaded into the cartridge accommodating section 110 in a loading direction 56, and is unloaded from the cartridge accommodating section 110 in an unloading direction 55 while maintaining the upstanding posture. Hereinafter, the loading direction 56 and the unloading direction 55 may be collectively referred to as a loading/unloading direction 50, whenever necessary, assuming that the loading direction 56 and the unloading direction 55 are interchangeable with each other.

The cartridge accommodating section 110 includes a case 101, an engaging member 145, an ink needle 113 and an optical sensor 114.

The case 101 defines an outer shape of the cartridge accommodating section 110. The ink cartridge 30 is accommodated in the case 101. The case 101 has an end wall opposite the opening 112.

The ink needle 113 is tubular shaped and is formed of a resin. The ink needle 113 is connected to the ink tube 20. The ink needle 113 is disposed at a lower end portion of the end wall of the case 101 to correspond to an ink supply portion 34 (described later) of the ink cartridge 30 mounted in the cartridge accommodating section 110. The ink needle 113 is inserted into an ink supply outlet 71 of the ink supply portion 34 (see FIGS. 2 to 3) when the ink cartridge 30 is being mounted in the cartridge accommodating section 110, thereby opening an ink supply valve 70 provided in the ink supply portion 34. As a result, the ink stored in an ink chamber 36 of the ink cartridge 30 is flowed out therefrom, through an ink passage 72 formed in the ink supply portion 34, into the ink tube 20 connected to the ink needle 113.

The optical sensor 114 is provided on the end wall of the case 101 at a position upward of the ink needle 113 in a gravity direction. The optical sensor 114 includes a light-emitting element (LED, for example) and a light-receiving element (phototransistor, for example). The optical sensor 114 has a horseshoe-shaped housing. The light-emitting element and the light-receiving element are disposed respectively on distal end portions of the horseshoe-shaped housing of the optical sensor 114 to oppose each other. In the present embodiment, the light-emitting element is configured to emit light in a horizontal direction (perpendicular to the loading/unloading direction 50) and the light-receiving element is configured to receive the light emitted from the light-emitting element. The light-emitting element and the light-receiving element define a space therebetween into which a detecting portion 33 of the ink cartridge 30 enters when the ink cartridge 30 is loaded into the cartridge accommodating section 110, as will be described later. When entering this space, the detecting portion 33 alters a path of light formed between the light-emitting element and the light-receiving element, thereby enabling the optical sensor 114 to detect changes in amount of light received by the light-receiving element.

Further, as shown in FIG. 1, the engaging member 145 is provided on an upper wall of the casing 101 at a position adjacent to the opening 112. Four engaging members 145 are provided for receiving four ink cartridges 30 in the present embodiment, but for explanatory purpose, only one engaging member 145 is depicted in FIG. 1. The engaging member 145 is configured to pivot about a shaft 147 provided near the opening 112 on the upper wall. When the ink cartridge 30 is mounted in the cartridge accommodating section 110, the engaging member 145 is configured to engage an engaging portion 45 of the ink cartridge 30 to keep the ink cartridge 30 mounted in the cartridge accommodating section 110 against a biasing force acting in the unloading direction 55, as will be described later.

For removing the ink cartridge 30 from the cartridge accommodating section 110, a user pushes down a rear end portion of a pivot member 80 (described later) provided on the ink cartridge 30 to cause the engaging member 145 to pivotally move counterclockwise. The engagement between the engaging member 145 and the engaging portion 45 is thus released by the pivotal movement of the pivot member 80, thereby permitting the ink cartridge 30 from being removed from the cartridge accommodating section 110.

3. Ink Cartridge

Figure 4:
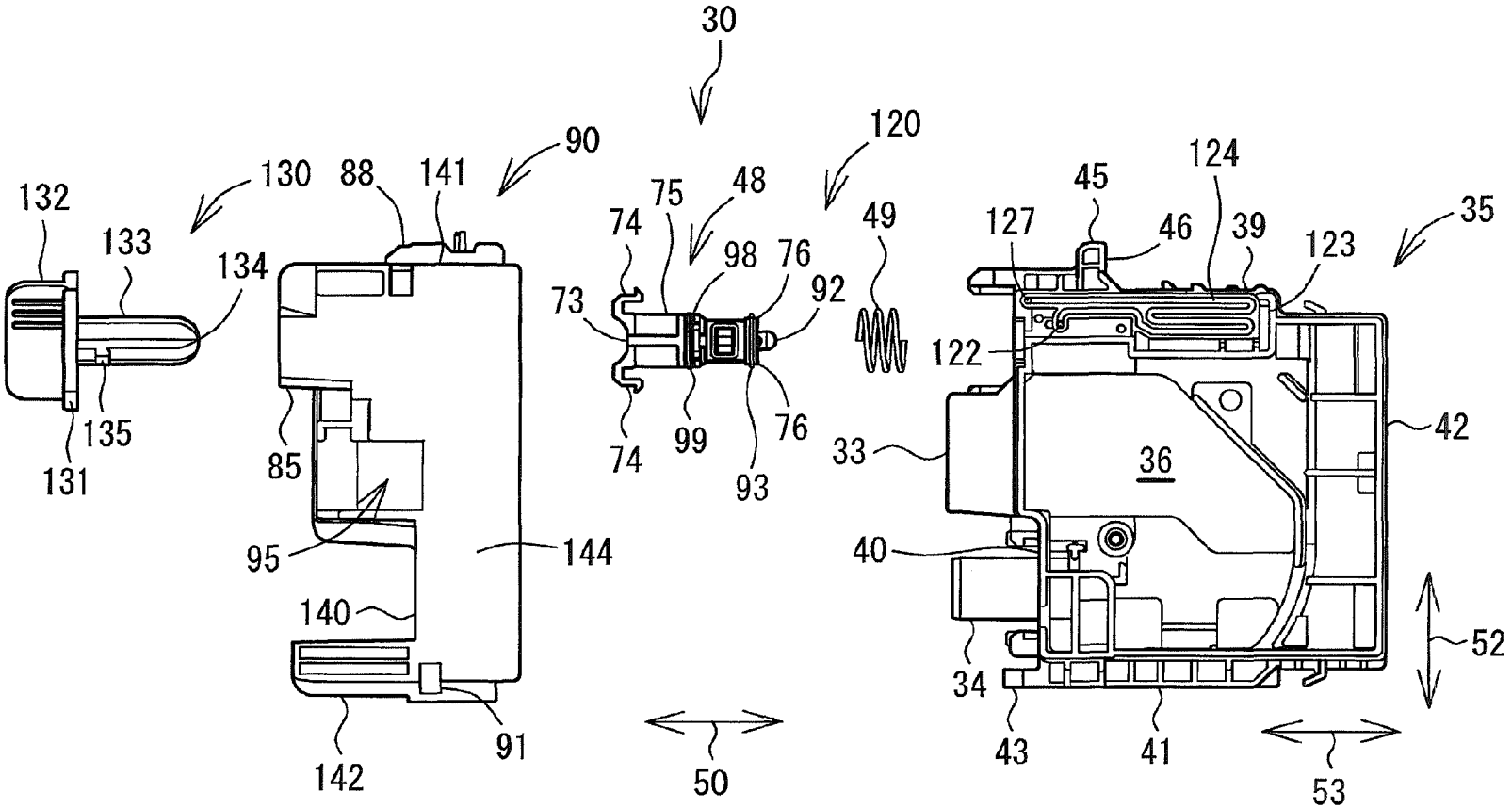
FIG. 4 is an exploded side view showing an internal structure of the ink cartridge according to the embodiment.

The ink cartridge 30 is a container configured to store ink therein. The ink cartridge 30 includes a cartridge body 31, a bracket 90, an inner frame 35 accommodated in the cartridge body 31, and a release member 130, as shown in FIGS. 2 to 4.

The ink cartridge 30 defines therein a space for storing ink and this space serves as the ink chamber 36. In the present embodiment, the ink chamber 36 is formed by the inner frame 35 accommodated in the cartridge body 31 and a pair of films 82 (see FIG. 1) attached to the inner frame 35. Alternatively, the ink chamber 36 may be defined by the cartridge body 31 itself.

The bracket 90 is assembled to the cartridge body 31 to form an outer shape of the ink cartridge 30. The inner frame 35 is housed within the cartridge body 31 and the bracket 90 assembled to each other.

In an assembled state, the ink cartridge 30 has a generally flat rectangular parallelepiped shape in outer appearance. The ink cartridge 30 has a width (in a direction indicated by an arrow 51 which will be referred to as widthwise direction), a height (in a direction indicated by an arrow 52 which will be referred to as height direction or vertical direction) and a depth (in a direction indicated by an arrow 53 which will be referred to as depthwise direction), the height and depth being greater than the width. In other words, side surfaces opposing each other in the widthwise direction 51 are surfaces with a largest area among surfaces constituting the ink cartridge 30.

The loading/unloading direction 50 of the ink cartridge 30 relative to the cartridge accommodating section 110 is coincident with the horizontal direction, or the depthwise direction 53 in the present embodiment. However, loading and unloading of the ink cartridge 30 relative to the cartridge accommodating section 110 may be performed in a direction parallel to a vertical direction, or a direction intersecting with both of the vertical and horizontal directions.

Hereinafter, whenever necessary, directions with respect to the ink cartridge 30 will be defined based on the upstanding posture shown in FIG. 2. That is, a leading side of the ink cartridge 30 in the loading direction 56 is referred to as the front side of the ink cartridge 30, whereas a trailing side of the ink cartridge 30 in the unloading direction 55 is referred to as the rear side of the ink cartridge 30. Specifically, the side at which the ink supply portion 34 is provided is the front side of the ink cartridge 30, whereas the side opposite to the side at which the ink supply portion 34 is provided in the depthwise direction 53 is the rear side of the ink cartridge 30. The front-rear direction is thus coincident with the depthwise direction 53 in the present embodiment.

(3-1) Cartridge Body

The cartridge body 31 is box-like shaped to have a hollow space defined therein for housing the inner frame 35. The cartridge body 31 includes a pair of side walls 37 and 38 opposed to each other in the widthwise direction 51 (the side wall 37 is not shown in drawings), and upper and lower walls 27 and 41 opposed to each other in the height direction 52. The cartridge body 31 also includes a rear wall 42 that serves as a trailing end of the ink cartridge 30 in the loading direction 56. The four walls 37, 38, 27, and 41 extend from the rear wall 42 in the depthwise direction 53. The cartridge body 31 is also formed with an open surface opposed to the rear wall 42 in the depthwise direction 53. The inner frame 35 is inserted into the space formed inside the cartridge body 31 through this open surface. When the inner frame 35 is accommodated in the cartridge body 31, the inner frame 35 is partially exposed from the cartridge body 31. That is, the cartridge body 31 covers a rear portion of the inner frame 35.

As illustrated in FIG. 1, the pivot member 80 is provided on the upper wall 27 of the cartridge body 31. The pivot member 80 has a bent plate-like shape and is disposed to extend in the depthwise direction 53. The pivot member 80 has a bent portion in which a pivot shaft (not illustrated) is provided. The pivot member 80 is configured to pivot about this pivot shaft. The pivot member 80 has a portion extending from the bent portion toward an engaging surface 46 (described later) formed in the engaging portion 45 of the cartridge body 31, and another portion extending from the bent portion toward the rear wall 42. That is, the pivot member 80 is configured of a portion frontward of the pivot shaft (frontward portion) and another portion rearward of the pivot shaft (rearward portion).

When the ink cartridge 30 is loaded in the cartridge accommodating section 110, the frontward portion of the pivot member 80 is positioned below the engaging member 145. The rearward portion of the pivot member 80 is pressed down by a user when the ink cartridge 30 is removed from the cartridge accommodating section 110 to release the engagement between the engaging member 145 and the engaging portion 45.

(3-2) Bracket

The bracket 90 has a box-like shape and is configured of a pair of side walls 143 and 144 opposed to each other in the widthwise direction 51 (the side wall 143 is not shown in the drawings), and upper and lower walls 141 and 142 opposed to each other in the height direction 52. The bracket 90 also has a front wall 140 that opposes the rear wall 42 of the cartridge body 31 in the depthwise direction 53 when the bracket 90 is assembled to the cartridge body 31. This front wall 140 serves as a leading end of the ink cartridge 30 when the ink cartridge 30 is being mounted in the cartridge accommodating section 110 in the loading direction 56. The four walls 143, 144, 141, and 142 extend from the front wall 140 in the depthwise direction 53. The bracket 90 also has an open surface that opposes the front wall 140 in the depthwise direction 53 when the bracket 90 is assembled to the cartridge body 31. The inner frame 35 is inserted inside the bracket 90 through this open surface. That is, the bracket 90 covers a front portion of the inner frame 35 that is not covered by the cartridge body 31.

When the bracket 90 is assembled to the cartridge body 31, the upper wall 141 of the bracket 90 and the upper wall 27 of the cartridge body 31 are in continuous with each other to constitute an upper wall of the ink cartridge 30. Similarly, the lower wall 142 of the bracket 90 and the lower wall 41 of the cartridge body 31 are in continuous with each other to constitute a lower wall of the ink cartridge 30. The side walls 143 and 144 of the bracket 90 and the side walls 37 and 38 of the cartridge body 31 constitute side walls of the ink cartridge 30, respectively. Further, in the assembled state of the ink cartridge 30, the front wall 140 of the bracket 90 constitutes a front wall of the ink cartridge 30 and the rear wall 42 of the cartridge body 31 constitutes a rear wall of the ink cartridge 30.

In the present embodiment, the direction in which the front and rear walls of the ink cartridge 30 (front wall 140 and rear wall 42) oppose each other (i.e., depthwise direction 53) is the front-rear direction (horizontal direction) and coincides with the loading/unloading direction 50. Thus, the direction in which the upper and lower walls of the ink cartridge 30 (upper walls 141, 39 and lower walls 142, 41) oppose each other (i.e., height direction 52) is coincident with the vertical direction (gravity direction).

A through-hole 95 is formed in the bracket 90 to penetrate each of the side walls 143 and 144 in the widthwise direction 51 at a position substantially center in the height direction 52 and adjacent to the front wall 140. The through-hole 95 functions to expose the detecting portion 33 of the inner frame 35 when the inner frame 35 is accommodated in the bracket 90. Thus, the through-hole 95 is formed so as to correspond to the detection portion 33 of the inner frame 35 in terms of position, dimension, and shape.

An elongated hole 91 is also formed in a lower end portion of each of the side walls 143, 144 of the bracket 90. When the bracket 90 is assembled to the cartridge body 31 in which the inner frame 35 has been accommodated, these elongated holes 91 are configured to engage with engagement claws 43 provided on the inner frame 35.

The front wall 140 is formed with a hole 96 at a position upward of the through-hole 95 in the height direction 52. The hole 96 penetrates the front wall 140 in the depthwise direction 53. In a state where the bracket 90 is assembled to the cartridge body 31, the hole 96 serves to receive the release member 130 functioning to open a sealed air communication portion 120 formed in the inner frame 35, as will be described later. When the bracket 90 is assembled to the cartridge body 31 as shown in FIG. 2, the hole 96 is positioned frontward of a protruding end of the ink supply portion 34 in the front-rear direction (depthwise direction 53), as will be described later.

On a peripheral wall defining the hole 96, a pair of cutouts 136 is formed to extend radially outward from the hole 96. Specifically, the cutouts 136 are positioned to diametrically oppose each other via the hole 96 in the widthwise direction 51.

The front wall 140 is also formed with a hole 97 at a position below the through-hole 95 with respect to the height direction 52. The hole 97 penetrates the front wall 140 in the depthwise direction 53. When the bracket 90 is assembled to the cartridge body 31, the ink supply portion 34 of the inner frame 35 is exposed outside through the hole 97. Thus, the hole 97 is formed so as to correspond to the ink supply portion 34 of the inner frame 35 in terms of position, dimension, and shape. The hole 97 is positioned rearward of the hole 96 in the front-rear direction (the depthwise direction 53).

The front wall 140 is provided with a first protrusion 85 and a second protrusion 86. As shown in FIGS. 2 to 4, the first protrusion 85 is formed at an upper end portion of the front wall 140 so as to protrude therefrom in a direction away from the front wall 140 (i.e., frontward, or in the loading direction 56). The hole 96 is formed on a protruding end of the first protrusion 85. The second protrusion 86 is formed at a lower end portion of the front wall 140 so as to protrude therefrom in a direction away from the front wall 140 (i.e., frontward, or in the loading direction 56). The hole 97 is positioned between the through-hole 95 and the second protrusion 86 with respect to the height direction 52.

Figure 6:
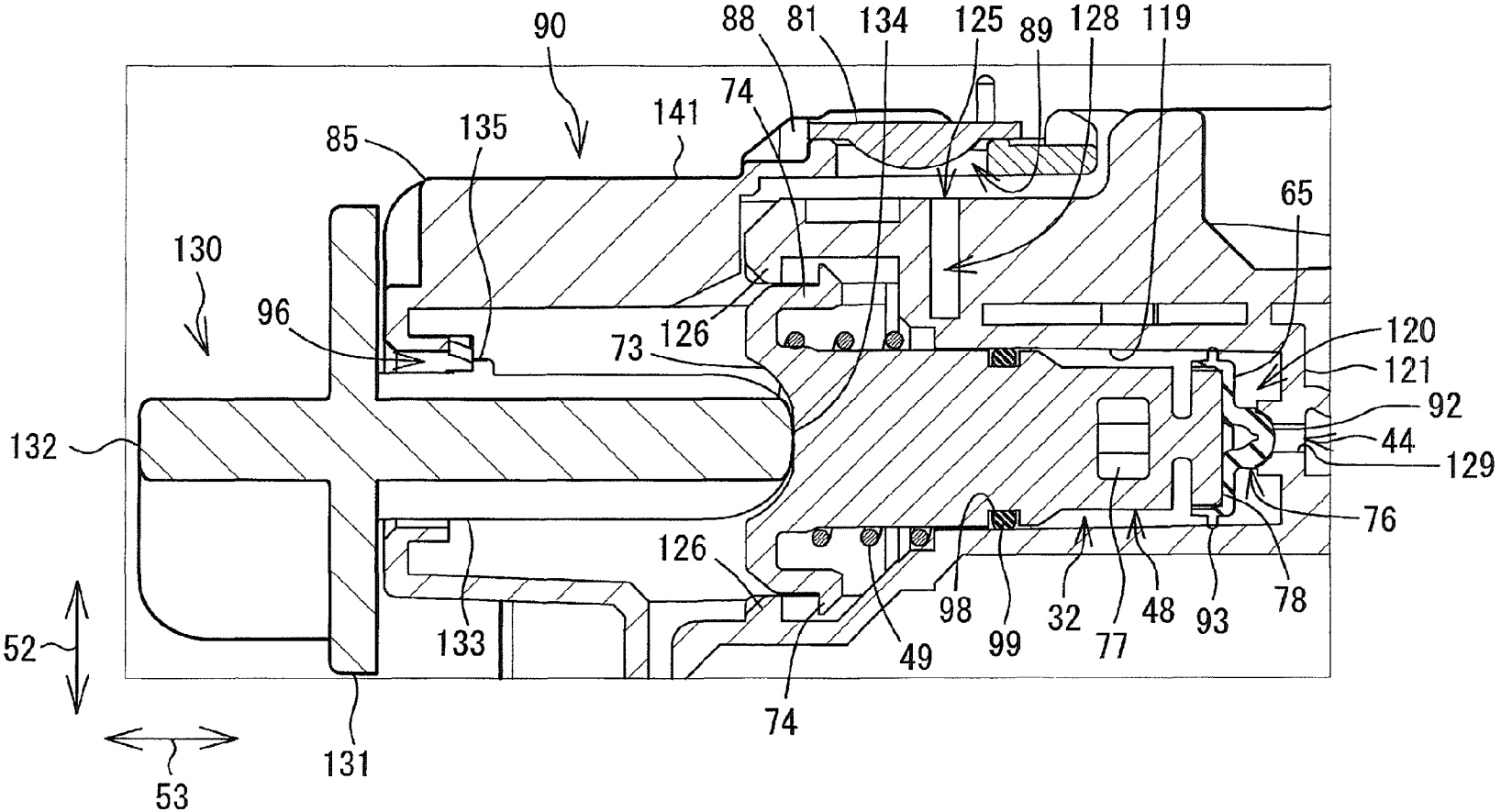
FIG. 6 is an enlarged view of an essential portion of the ink cartridge enclosed by a rectangle shown in FIG. 5, the essential portion including a valve chamber and a valve disposed within the valve chamber.

The upper wall 141 of bracket 90 is formed with an opening 89 (see FIG. 6) penetrating the upper wall 141 in the height direction 52. Referring to FIG. 6, in the state wherein the inner frame 35 has been inserted in the bracket 90, the opening 89 serves to expose an air communication port 125 (described later) formed in the inner frame 35 to atmosphere, as will be described later. Thus, the opening 89 is formed so as to correspond to the air communication port 125 of the inner frame 35 in terms of position, dimension, and shape. Specifically, the opening 89 has a diameter larger than that of the air communication port 125. The opening 89 is positioned to be spaced away from the air communication port 125 but is aligned with the air communication port 125 in the height direction 52.

A supporting portion 88 is formed adjacent to the opening 89 on the upper wall 141. The supporting portion 88 is adapted to receive a memory chip 81 having a rectangular flat plate-like shape. Specifically, the supporting portion 88 has a claw-like shape to be engaged with a peripheral end of the memory chip 81. When the memory chip 81 is coupled to the supporting portion 88, the opening 89 is closed by (covered with) the memory chip 81. Instead of the claw-like shape, the supporting portion 88 may be formed as a surface to which an adhesive tape can be attached for fixing a back side of the memory chip 81. Or the memory chip 81 may be fixed to the supporting portion 88 by melting a boss-shaped resin.

The memory chip 81 is a flat plate-shaped substrate having a top surface on which electrodes (shown without reference numerals) are disposed. The memory chip 81 also includes an IC configured to store various electrical signals. More specifically, the IC is configured to store various information on the ink cartridge 30 as electrical signals: for example, information on a type of the ink cartridge 30, such as an ink color, ink component, and initial amount of ink stored in the ink chamber 36.

The electrodes of the memory chip 81 are exposed upward to allow electrical connection thereto by an external access. When the ink cartridge 30 is mounted in the cartridge accommodating section 110, electrical contacts 106 (FIG. 1) provided on the cartridge accommodating section 110 electrically contact the electrodes to achieve power supply to the memory chip 81, thereby enabling the information stored in the IC to be retrieved therefrom.

(3-3) Inner Frame

As shown in FIGS. 3 and 4, the inner frame 35 is formed in a rectangular ring-like shape (or frame-like shape) whose pair of surfaces opposed to each other in the widthwise direction 51 are partially open. Each of the opened surfaces is sealed by the film 82 (see FIG. 1) to form the ink chamber 36 in the inner frame 35 for storing ink.

The ink chamber 36 is a space configured to store ink in a free state. Storing ink in a free state means that ink is freely movably stored within the ink chamber 36 without resisting gravity. This is contrast to a state where ink is absorbed and retained in a three-dimensional mesh-structured material, such as a sponge or foam, against gravity.

The inner frame 35 has a front wall 40 serving to partially define the ink chamber 36. The front wall 40 opposes the front wall 140 of the bracket 90 in the depthwise direction 53 when the inner frame 35 is inserted in the bracket 90. The inner frame 35 is provided with the detection portion 33, the ink supply portion 34, the air communication portion 120, and a valve chamber 32.

The detecting portion 33 protrudes frontward (in the loading direction 56) from the front wall 40 at a generally intermediate position in the height direction 52. The detecting portion 33 has a box-like shape whose one end is open so as to allow the ink in the ink chamber 36 to be in fluid communication with the detecting portion 33 via the open end. The detecting portion 33 is exposed outside of the bracket 90 through the through-hole 95 when the bracket 90 is assembled to the cartridge body 31. The detecting portion 33 has a pair of side walls made from a light transmissive resin. In the present embodiment, these side walls are configured to allow the light emitted from the optical sensor 114 (FIG. 1) to pass therethrough in the direction perpendicular to the loading/unloading direction 50 (i.e., the widthwise direction 51 or horizontal direction). The light may be infrared light or visible light.

The detecting portion 33 provides therein a hollow space between the pair of side walls such that ink can be present therebetween. Within this hollow space, an indicator 62 of a sensor arm 60 is movably positioned, as shown in FIG. 1.

Figure 5:
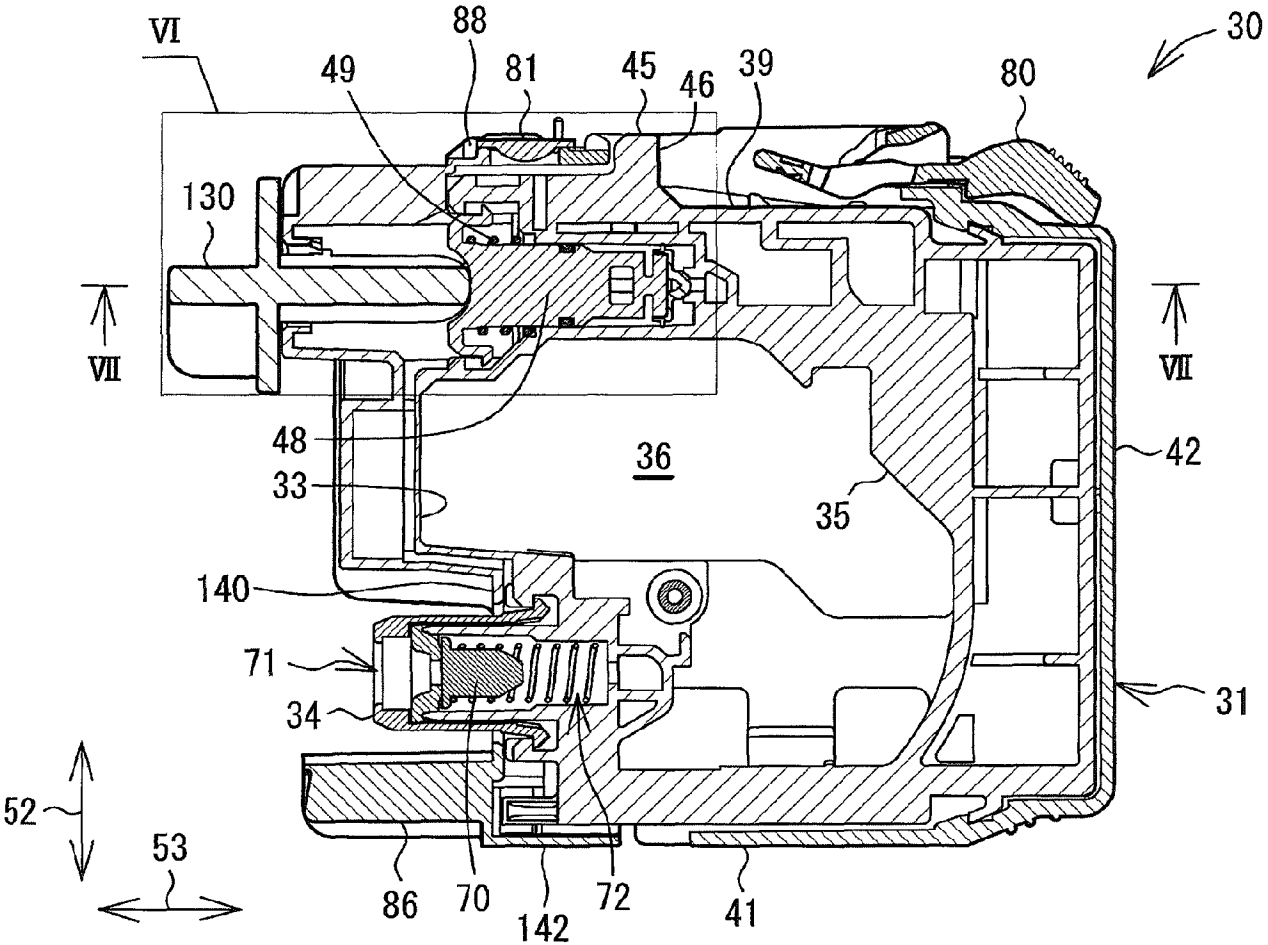
FIG. 5 is a vertical cross-sectional view showing the internal structure of the ink cartridge according to the embodiment, wherein the release member has been assembled to the ink cartridge.

The sensor arm 60 is pivotably movably provided in the ink chamber 36. The sensor arm 60 includes an arm body 61 and a pivot shaft 64. The arm body 61 is plate-like shaped, and is pivotally movably supported to the pivot shaft 64. The pivot shaft 64 extends in the widthwise direction 51 and is supported to the inner frame 35. The arm body 61 has one free end provided with the indicator 62 movably positioned in the hollow space of the detecting portion 33, and another free end provided with a float 63 dipped in the ink. With this structure, the sensor arm 60 is adapted to change its pivoting posture in accordance with an amount of the ink in the ink chamber 36 between a lower position in which the indicator 62 approaches a lower wall of the detecting portion 33 and an upper position in which the indicator 62 approaches an upper wall of the detecting portion 33. In FIGS. 4 and 5, the sensor arm 60 is omitted.

With this structure, when the ink cartridge 30 is mounted in the cartridge accommodating section 110, the detecting portion 33 can change its light transmission state between a transmissive state and a non-transmissive state. In the transmissive state, not less than a predetermined amount of infrared light from the optical sensor 114 can be transmitted through the detecting portion 33 as the sensor arm 60 is at the upper position, and in the non-transmisive state, less than the predetermined amount of infrared light is transmitted therethrough (i.e., the light may be shut off or attenuated) as the sensor arm 60 is at the lower position. In accordance with the light transmission state at the detecting portion 33, the printer 10 can detect whether the amount of ink in the ink chamber 36 is less than the prescribed amount.

As shown in FIG. 4, the ink supply portion 34 is provided at the front wall 40 below the detecting portion 33. The ink supply portion 34 has a hollow cylindrical shape protruding from the front wall 40 in the loading direction 56, i.e., frontward in the front-rear direction. The ink supply portion 34 is exposed outside through the hole 97 formed in the bracket 90 when the ink cartridge 30 is assembled.

The ink supply portion 34 has a protruding end in which the ink supply outlet 71 is formed. As shown in FIG. 1, the ink passage 72 is formed inside the ink supply portion 34. The ink passage 72 extends in the depthwise direction 53 so as to permit fluid communication between the ink supply outlet 71 and the ink chamber 36 through the ink passage 72. The ink supply valve 70 is disposed in the ink passage 72 to open and close the ink supply outlet 71.

Upon loading of the ink cartridge 30 into the cartridge accommodating section 110, the ink needle 113 is inserted into the ink supply outlet 71. The ink needle 113 moves the ink supply valve 70 rearward in the front-rear direction to open the ink supply outlet 71. Thus, the ink in the ink chamber 36 is permitted to flow into the ink needle 113 via the ink passage 72. In the present embodiment, the ink flows out in a direction generally coincident with the loading direction 56 (or frontward in the front-rear direction).

Instead of the ink supply valve 70, a film covering the ink supply outlet 71 may be provided. In the latter case, the ink needle 113 breaks the film to open the ink supply outlet 71 upon loading of the ink cartridge 30 into the cartridge accommodating section 110.

As illustrated in FIG. 4, a pair of engagement claws 43 is formed at a lower end portion of the front wall 40 of the inner frame 35. Each engagement claw 43 has a distal end portion that protrudes outward in the widthwise direction 51. The engagement claws 43 define a distance therebetween in the widthwise direction 51 such that the engagement claws 43 can resiliently deform inward in the widthwise direction 51. Upon assembly of the bracket 90 to the cartridge body 31 and the inner frame 35, the distal end portions of the engagement claws 43 respectively enter the pair of elongated holes 91 formed in the bracket 90 and engage inner peripheral surfaces of cylindrical inner walls constituting the elongated holes 91.

The inner frame 35 has an upper wall 39 in which the engaging portion 45 is formed. The engaging portion 45 includes the engaging surface 46 extending in the widthwise direction 51 and the height direction 52. The engaging surface 46 is configured to engage the engaging member 145 of the cartridge accommodating section 110 when the ink cartridge 30 has been loaded in the cartridge accommodating section 110. When engaged with the engaging member 145, the engaging portion 45 (engaging surface 46) is adapted to receive (resist) a biasing force acting in the unloading direction 55 to keep the ink cartridge 30 mounted in the cartridge accommodating section 110, the biasing force being generated by the ink supply valve 70 pushing the ink needle 113.

The air communication portion 120 is formed in the inner frame 35 at a position higher than the detection portion 33 in the height direction 52, as shown in FIGS. 4 and 5. The air communication portion 120 is configured to allow the ink chamber 36 to communicate with outside of the ink cartridge 30.

The air communication portion 120 includes an air flow path through which the ink chamber 36 is permitted to communicate with outside. The air communication portion 120 also includes a valve 48, and a coil spring 49 biasing the valve 48.

The air flow path is formed between the ink chamber 36 and outside of the ink cartridge 30 in the inner frame 35. Specifically, the air flow path connects between a communication hole 44 (see FIG. 6) in communication with the ink chamber 36 and the air communication port 125 in communication with atmosphere.

The air communication port 125 is formed on the upper wall 39 at a position frontward of the engaging portion 45 to oppose a back surface of the memory chip 81, as shown in FIG. 6. The air communication port 125 is open on the upper wall 39 and is in communication with an air path 128 (described later) in the height direction 52. As shown in FIG. 2, since the air communication port 125 is covered with the bracket 90 and the memory chip 81 in the assembled ink cartridge 30, a user cannot visually confirm the air communication port 125 from outside. However, the air communication port 125 is in communication with atmosphere (outside of the ink cartridge 30) through minute gaps formed between the bracket 90 and the inner frame 35, for example.

The communication hole 44 is a hole formed in a partition wall 121 that partitions between the valve chamber 32 and the ink chamber 36, as shown in FIG. 6. Specifically, the communication hole 44 is positioned in a center of the partition wall 121 in the widthwise direction 51. The communication hole 44 is defined by an inner peripheral wall 129 to penetrate the partition wall 121 in the depthwise direction 53. The valve chamber 32 is a space formed in the inner frame 35 to receive the valve 48. The valve chamber 32 is thus communicable with the ink chamber 36 via the communication hole 44. As shown in FIGS. 5 and 6, the valve chamber 32 is defined by a cylindrical-shaped peripheral wall 119 extending from the partition wall 121 toward the front wall 40 in the depthwise direction 53. The valve chamber 32 thus has an open end near the front wall 40, the open end being opposite to the partition wall 121 in the depthwise direction 53. The communication hole 44 is positioned on an axis of the cylindrical-shaped valve chamber 32 that is coincident with the depthwise direction 53. In other words, the communication hole 44 is positioned on a center in the widthwise direction 51 and in the height direction 52. The peripheral wall 119 defining the valve chamber 32 is formed with a through-hole 122 (see FIGS. 4 and 8) extending to a left wall 123 of the inner frame 35. That is, the through-hole 122 is open on the left wall 123.

The left wall 123 of the inner frame 35 is formed with a winding labyrinth path 124, as shown in FIG. 4. Specifically, the labyrinth path 124 is a space defined by grooves formed in the left wall 123 and the film 82 attached to the left wall 123. As shown in FIG. 4, the labyrinth path 124 is formed to be aligned with the valve chamber 32 in the widthwise direction 51.

The labyrinth path 124 has one end communicating with the through-hole 122, and another end communicating with the air path 128. Specifically, the labyrinth path 124 extends from the through-hole 122 generally rearward, and approaches the upper wall 39 while making U-turns and extending in the depthwise direction 53. Reaching near the upper wall 39, the labyrinth path 124 then extends linearly frontward and finally reaches a through-hole 127 formed in the left wall 123. The through-hole 127 is in communication with the air path 128 that is in communication with the air communication port 125. The air path 128 penetrates the left wall 123 in the widthwise direction 51, extends to the upper wall 39 and penetrates therethrough to be in communication with the air communication port 125.

In this way, the ink chamber 36 can be in communication with atmosphere via the communication hole 44, the valve chamber 32, the through-hole 122, the labyrinth path 124, the through-hole 127, the air path 128, and the air communication port 125. This path for achieving air flow between the ink chamber 36 and outside of the ink cartridge 30 is defined as the air flow path formed in the air communication portion 120.

In the inner frame 35, a pair of engaging claws 126 is formed frontward of the valve chamber 32 near the front wall 40. Specifically, the engaging claws 126 are formed adjacent to the open end of the valve chamber 32 to protrude radially inward of the same. The engaging claws 126 are spaced away from each other in the height direction 52. The engaging claws 126 are adapted to engage with a pair of engaging claws 74 formed on the valve 48 so that the valve 48 is prevented from being popped out from the valve chamber 32 due to a biasing force of the coil spring 49.

The valve 48 is movably disposed within the valve chamber 32. Specifically, the valve 48 is movable in the front-rear direction between a first position shown in FIGS. 6 and 7 and a second position shown in FIG. 8. The valve 48 closes the communication hole 44 at the first position, and opens the communication hole 44 at the second position, as will be described in detail later.

As shown in FIGS. 6 through 10, the valve 48 includes a valve main body 75, a sealing member 76, and an O-ring 99.

The valve main body 75 has an outer profile in conformance with the cylindrical-shaped valve chamber 32 so as to be inserted into the same. The valve main body 75 has a generally columnar shape elongated in the depthwise direction 53 and defining an axis extending in the depthwise direction 53. The valve main body 75 has an outer diameter smaller than an inner diameter of the valve chamber 32. Note that, referring to FIGS. 9 and 10, the valve main body 75 is not actually columnar shaped as a whole, but has an outer contour of a generally columnar shape. The outer contour of the valve main body 75 is formed by various end faces, including end faces of cross-shaped ribs extending radially outward from an axial center portion of the valve main body 75.

Figure 9:
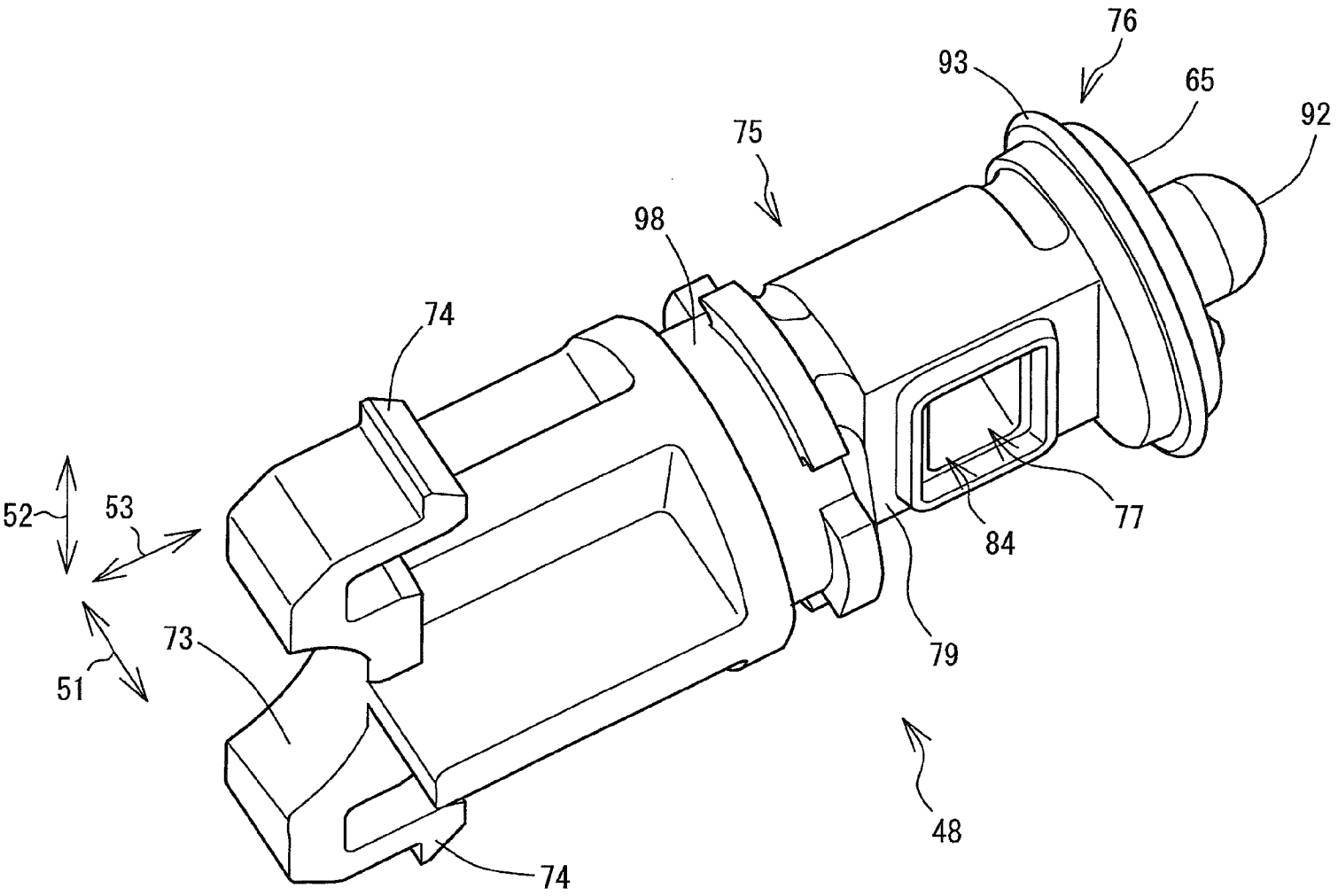
FIG. 9 is a perspective view showing an external appearance of the valve according to the embodiment.
Figure 10:
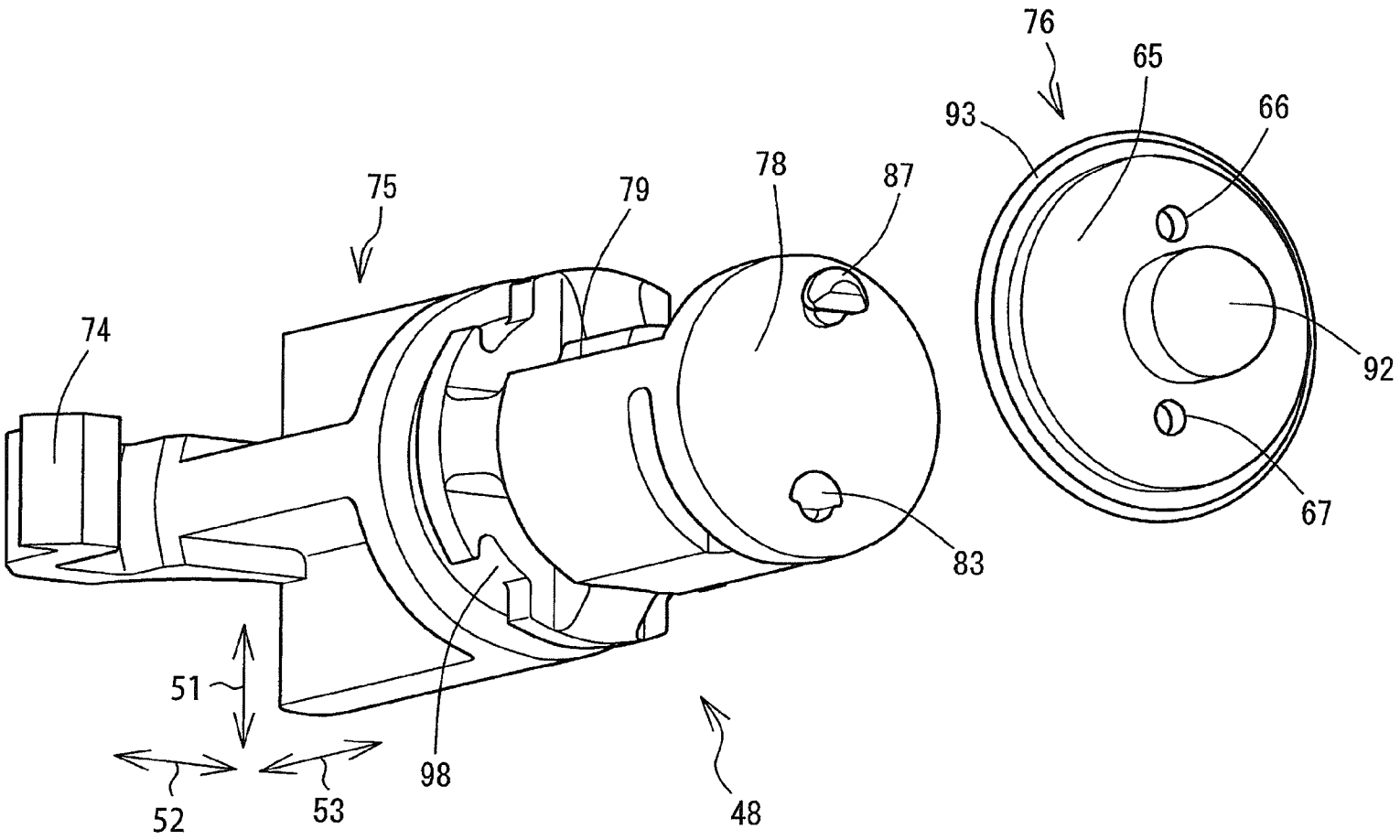
FIG. 10 is an exploded view of the valve according to the embodiment.

The valve main body 75 is formed with a first opening 83, a second opening 84, and an air passage 77 connecting between the first opening 83 and the second opening 84, as shown in FIGS. 9 and 10.

Figure 7:
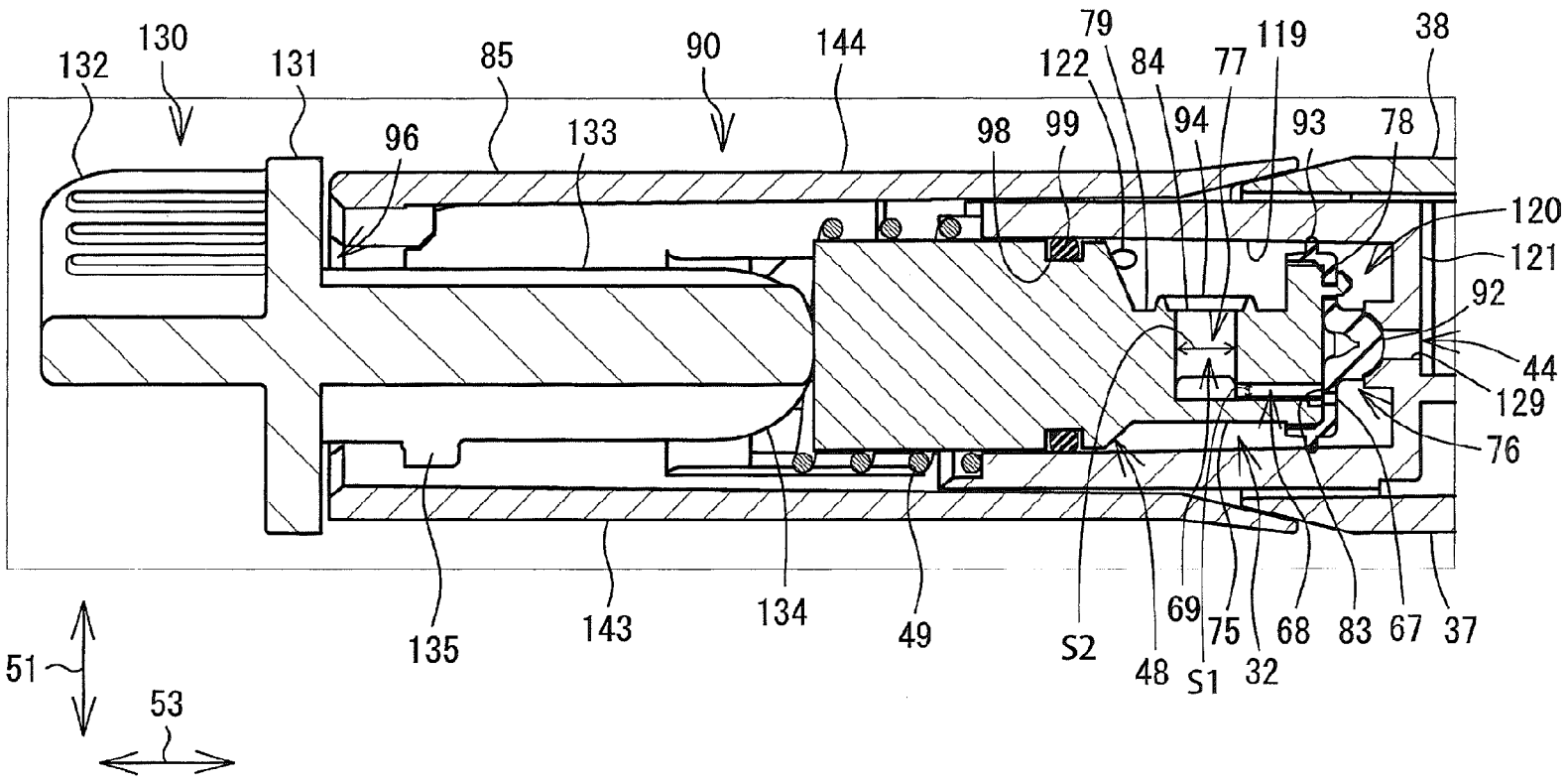
FIG. 7 is an enlarged cross-sectional view of the essential portion of the ink cartridge of the embodiment taken along a plane VII-VII shown in FIG. 5, wherein the valve is in a first position.
Figure 8:
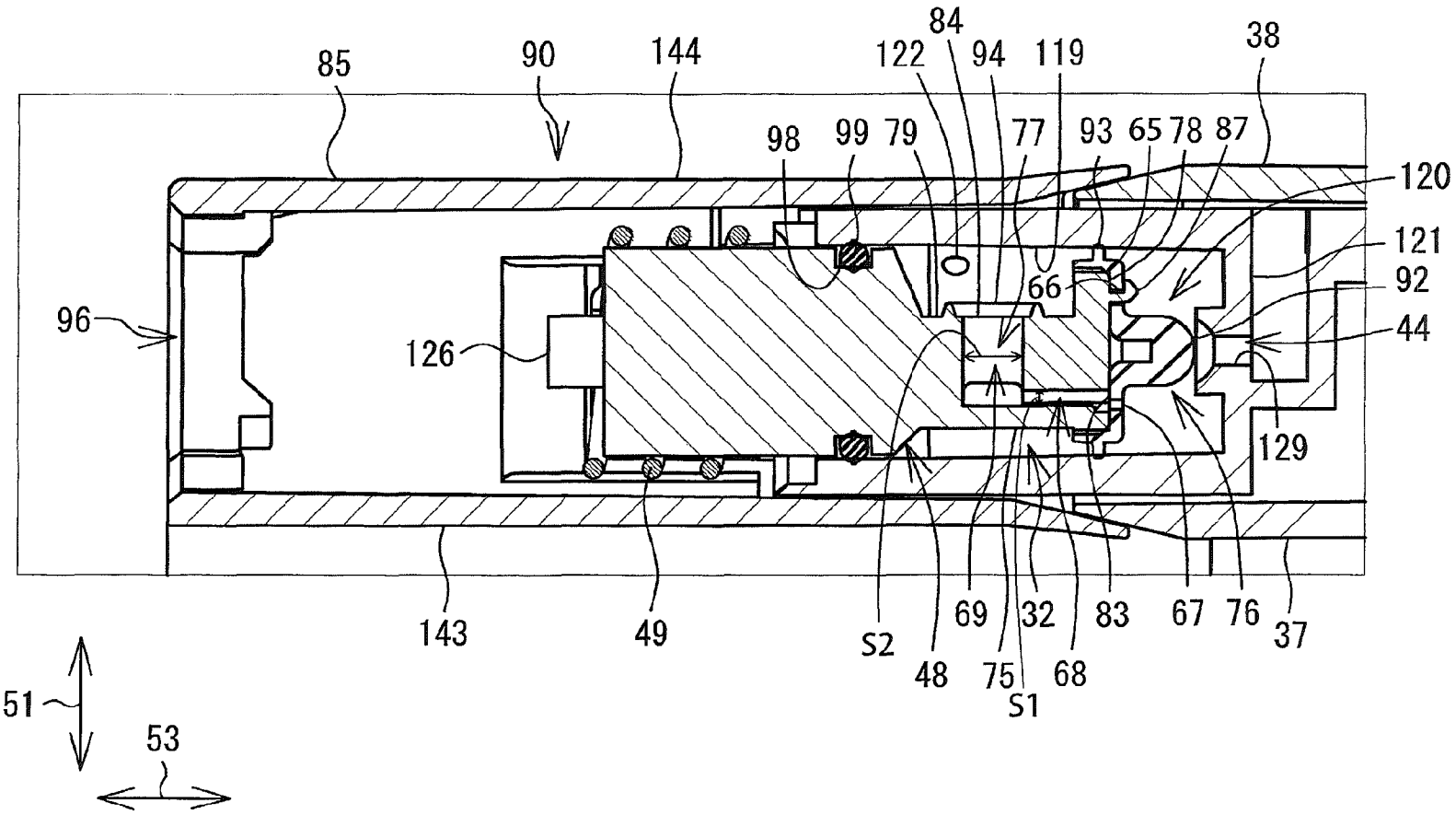
FIG. 8 is an enlarged cross-sectional view of the essential portion of the ink cartridge of the embodiment taken along the plane VII-VII shown in FIG. 5, wherein the valve is in a second position.

The valve main body 75 has an end face 78 configured to oppose the partition wall 121 in the depthwise direction 53 within the valve chamber 32 (see FIGS. 6 to 8). The first opening 83 is open on this end face 78, as shown in FIG. 10. On the end face 78, the first opening 83 is positioned offset from a center of the end face 78 (axis of the valve main body 75) but away from a periphery (outermost ends) of the end face 78 with respect to the widthwise direction 51.

The second opening 84 is formed on a side surface 79 of the valve main body 75, the side surface 79 facing the peripheral wall 119 defining the valve chamber 32.

More specifically, the first opening 83 is positioned on the end face 78 at a side opposite to the second opening 84 with respect to a center of the end face 78. In other words, the first opening 83 and the second opening 84 are positioned opposite to each other with respect to a center of the valve main body 75 (the axis of the valve main body 75) in the widthwise direction 51. In the height direction 52, the first opening 83 is positioned at the same height as the center of the end face 78 (the center of the valve main body 75). This means that the first opening 83 is positioned at the same height as the communication hole 44 in the height direction 52 when the valve 48 is disposed within the valve chamber 32. The first opening 83 has a diameter smaller than a diameter of the communication hole 44.

The air passage 77 extends from the first opening 83 in the depthwise direction 53 and then bends in a direction perpendicular to the depthwise direction 53 (i.e., in the widthwise direction 51) to reach the second opening 84 (refer to FIGS. 7 and 8).

Specifically, the air passage 77 is configured of a first passage 68 and a second passage 69. As shown in FIGS. 7 and 9, the first passage 68 is a portion extending in the depthwise direction 53 from the first opening 83, and the second passage 69 is a portion extending from a front end of the first passage 68 and bending in the widthwise direction 51 to be connected to the second opening 84. That is, the air passage 77 is a passage connecting the end face 78 and the side surface 79 within the valve main body 75 to establish fluid communication between the first opening 83 and the second opening 84.

The second passage 69 has a cross-sectional area S2 larger than a cross-sectional area S1 of the first passage 68 ($S1<S2$), as shown in FIGS. 7 and 8. Here, the cross-sectional area S2 is defined on a plane perpendicular to the widthwise direction 51, and has a generally rectangular shape in conformance with the outline of the second opening 84 (see FIG. 9). On the other hand, the cross-sectional area S1 is defined on a plane perpendicular to the depthwise direction 53 and has a generally circular shape in conformance with the outline of the first opening 83 (see FIG. 10). Put another way, the cross-sectional area S2 of the second passage 69 has a larger area than the cross-sectional area S1 of the first passage 68 with respect to a direction perpendicular to the direction of air flow that will be established upon insertion of the ink cartridge 30 into the cartridge accommodating section 110.

The valve main body 75 has one end on which the pair of engaging claws 74 is formed, the one end being opposite to the end face 78 in the depthwise direction 53. The engaging claws 74 are hook-like shaped and spaced apart from each other in the height direction 52. More specifically, each engaging claws 74 extends outward (upward or downward in the height direction 52) from the one end of the valve main body 75 and then bends toward the end face 78 with a distance kept from an outer surface of the valve main body 75. Each engaging claw 74 has a distal end portion extending away from the outer surface of the valve main body 75 to form a hook-like shape. The engaging claws 74 (precisely, distal end portions thereof) are respectively configured to be engaged with the engaging claws 126 formed at the open end of the valve chamber 32 when the valve 48 is inserted into the valve chamber 32. Due to the engagement between the engaging claws 74 and the engaging claws 126, the valve 48 is prevented from coming out of the valve chamber 32.

The engaging claws 74 define a curved surface 73 therebetween in the height direction 52, as shown in FIGS. 6 and 9. The curved surface 73 has a concaved shape in a side view, being recessed toward the end face 78. The curved surface 73 defines a center that is most recessed toward the end face 78

(deepest position in the depthwise direction 53) and the center is generally coincident with the axis (axial center) of the valve main body 75 and the center of the communication hole 44 formed in the partition wall 121. The curved surface 73 is configured to receive the release member 130 inserted into the valve chamber 32.

On the end face 78, an engaging portion 87 is also formed. The engaging portion 87 is provided at a position symmetrical with the first opening 83 with respect to the center of the end face 78. The engaging portion 87 has a hook-like shape, protruding radially outward. The engaging portion 87 functions to achieve engagement between the end face 78 and the sealing member 76.

The sealing member 76 is provided to cover the end face 78 of the valve main body 75. The sealing member 76 is made of an elastically deformable material, such as rubber and elastomer. The sealing member 76 has a cap-like shape for hermetically sealing the end face 78.

The sealing member 76 includes a circular-shaped cap portion 65, a protruding portion 92, and a flange portion 93.

The cap portion 65 has a cap-like shape, and is formed with through-holes 66 and 67. The through-holes 66 and 67 are both positioned offset from a diametrical center of the cap portion 65 toward a periphery thereof, but away from the periphery (outermost ends) of the cap portion 65 in the widthwise direction 51. The through-hole 66 receives the engaging portion 87 therein such that the engaging portion 87 penetrates and engages the through-hole 66. The sealing member 76 is thus assembled to the end face 78 of the valve main body 75 such that the sealing member 76 is in close contact with the end face 78 in an air-tight manner. The through-hole 67 is positioned to correspond to the first opening 83 of the valve main body 75. The through-hole 67 has a diameter smaller than the diameter of the communication hole 44.

With this structure, the air passage 77 is permitted to communicate with the valve chamber 32 (or a portion of the valve chamber 32 facing the partition wall 121; or first chamber as described below) through the through-hole 67 even when the end face 78 of the valve main body 75 is covered (sealed) with the sealing member 76.

The protruding portion 92 protrudes in a direction away from the end face 78 from the cap portion 65 at a position generally center thereof. The protruding portion 92 has a dome-like shape, defining a hollow space therein. That is, a space is provided between the valve main body 75 and the protruding portion 92. Therefore, the protruding portion 92 can elastically deform inward to allow a volume of the hollow space to shrink so that the protruding portion 92 can be in close contact with the inner peripheral wall 129 defining the communication hole 44, thereby realizing sealing of the communication hole 44.

The flange portion 93 is formed to protrude radially outward from an entire circumferential portion of the cap portion 65. The flange portion 93 has a ring-like shape (O-shape) in a plan view, and functions as an O-ring. The flange portion 93 is configured to be in close contact with and in sliding contact with the peripheral wall 119 of the valve chamber 32 to partition the valve chamber 32 into two chambers: a first chamber in communication with the through-hole 67 as well as with the ink chamber 36 via the communication hole 44; and a second chamber in communication with the second opening 84 as well as with the labyrinth path 124 via the through-hole 122.

The second opening 84 formed on the side surface 79 of the valve main body 75 is covered with a semipermeable membrane 94, as shown in FIGS. 7 and 8. The semipermeable membrane 94 is made of a porous membrane having minute holes and is configured to allow passage of air but restrict passage of liquid (i.e., ink in the present embodiment). For example, the semipermeable membrane 94 may be made of a fluorine resin, such as polytetrafluoroethylene, polychlorotrifluoroethylene, tetrafluoroethylene-hexafluoropropylen copolymer, tetrafluoroethylene-perfluoroalkylvinylether copolymer, and tetrafluoroethylene-ethylene copolymer. In FIGS. 9 and 10, the semipermeable membrane 94 is omitted.

With this structure, since the second opening 84 of the air passage 77 is closed by the semipermeable membrane 94 that permits air flow but restricts passage of ink, ink is prevented from flowing into the labyrinth path 124 that is positioned downstream of the semipermeable membrane 94 (closer to the air communication port 125 than the semipermeable membrane 94 to the air communication port 125) in the air flow path of the ink cartridge 30.

The valve main body 75 is further formed with a groove 98 between the second opening 84 and the engaging claws 74, as shown in FIGS. 9 and 10. The groove 98 extends along a periphery (circumference) of the valve main body 75 to fittingly receive the O-ring 99 (the O-ring 99 is omitted in FIGS. 9 and 10). As shown in FIGS. 7 and 8, the O-ring 99 is configured to be in sliding contact with and in close contact with the peripheral wall 119 of the valve chamber 32 to realize air-tight sealing of the valve chamber 32. Due to this gastight sealing of the valve chamber 32 by the O-ring 99, evaporation of moisture from ink can be prevented in the air flow path of the ink cartridge 30. Moreover, due to the provision of the O-ring 99, the labyrinth path 124 is communicable with atmosphere only through the air communication port 125 in the air flow path. The intricate construction of the labyrinth path 124 by itself also serves to suppress ink from getting dried by communication with ambient air through the air communication port 125.

As described above, the first chamber defined by the partition wall 121 and the flange portion 93 is in fluid communication with the ink chamber 36 via the communication hole 44. The second chamber defined by the flange portion 93 and the O-ring 99 is in communication with the first chamber through the through-hole 67, the first opening 83, the air passage 77 and the second opening 84. When the communication hole 44 is opened, ink may possibly flow from the ink chamber 36 into the first chamber and then into the air passage 77 via the through-hole 67 and the first opening 83. However, since the second opening 84 is covered with the semipermeable membrane 94, ink entering into the air passage 77 is prevented from flowing out therefrom, i.e., the semipermeable membrane 94 prevents ink flow from the first chamber to the second chamber. In other words, the flange portion 93 of the sealing member 76 functions to achieve liquid-tight sealing between the first chamber and the second chamber within the valve chamber 32 in conjunction with the semipermeable membrane 94. Put another way, the first chamber of the valve chamber 32 also functions as an ink buffer chamber in the present embodiment.

As shown in FIGS. 5 and 6, in a state where the valve 48 has been inserted in the valve chamber 32, the coil spring 49 is disposed between a peripheral portion of the inner frame 35 defining the open end of the valve chamber 32 and the engaging claws 74. The valve 48 is thus normally biased in a direction away from the partition wall 121 (leftward in FIGS. 5 and 6, or frontward) by the biasing force of the coil spring 49, as shown in FIG. 8. This position of the valve 48 shown in FIG. 8 is the second position.

Specifically, in the second position, while the valve 48 receives the biasing force from the coil spring 49, the engaging claws 74 of the valve main body 75 are engaged with the engaging claws 126 of the inner frame 35 to prevent the valve 48 from coming out of the valve chamber 32. The valve 48 is thus retained in the second position, as shown in FIG. 8. At this time, the protruding portion 92 of the sealing member 76 is separated from the communication hole 44 and the communication hole 44 is opened.

In contrast, in the first position as shown in FIGS. 6 and 7, the valve 48 is pressed rearward (rightward in FIGS. 5 to 7) by the release member 130 inserted in the valve chamber 32 against the biasing force of the coil spring 49. The protruding portion 92 of the sealing member 76 is thus tightly fitted with the inner peripheral wall 129 to close the communication hole 44. At this time, the engaging claws 126 and the engaging claws 74 are separated from each other in the depthwise direction 53 by a prescribed distance, as shown in FIG. 6. In other words, this distance by which the engaging claws 74 in the first position are separated from the engaging claws 126 is equivalent to a distance by which the valve 48 is movable in the depthwise direction 53.

When the valve 48 is retained at the second position, the ink chamber 36 is in communication with ambient air (outside of the ink cartridge 30) through the communication hole 44, the valve chamber 32 (the first chamber defined between the partition wall 121 and the flange portion 93; the air passage 77 connecting between the first opening 83 and the second opening 84; and the second chamber defined between the flange portion 93 and the O-ring 99), the through-hole 122, the labyrinth path 124, the air path 128, and the air communication port 125. All of these elements serving to permit air flow between the ink chamber 36 and atmosphere constitute the air flow path of the air communication portion 120 in the ink cartridge 30.

(3-4) Release Member

The release member 130 is assembled to the hole 96 of the bracket 90, as shown in FIGS. 2 and 5 to 7. As described above, when assembled to the bracket 90, the release member 130 pushes the valve 48 rearward to maintain the valve 48 at the first position against the biasing force of the coil spring 49.

The release member 130 includes a base 131, a handling rib 132 and a rod 133. The base 131 has a flat plate-like shape. The base 131 has a front surface from which the handling rib 132 protrudes frontward, and a rear surface from which the rod 133 protrudes rearward. The rear surface of the base 131 can abut on the protruding end of the first protrusion 85 of the bracket 90.

The handling rib 132 is thin plate-like shaped and has a size that permits a user to hold the handling rib 132 with his fingers (see FIG. 2).

The rod 133 is a cross-shaped rib extending in the depthwise direction 53. The rod 133 is sized to be insertable into the hole 96 of the bracket 90. The rod 133 is formed in a front-rear length suitable for pressing the valve 48 into the first position. More specifically, the rod 133 has a tip end portion (more specifically, a leading surface 134) that is configured to abut on the curved surface 73 of the valve 48 while the release member 130 is being inserted into the hole 96 for assembly to the bracket 90. In a state where the release member 130 has been assembled to the bracket 90 and the rear surface of the base 131 is in abutment with the protruding end of the first protrusion 85 of the bracket 90, the valve 48 has been pushed rearward into the valve chamber 32 to be maintained at the first position against the biasing force of the coil spring 49, while the leading surface 134 is in abutment with the curved surface 73. At this time, since the center of the curved surface 73 is generally coincident with the axial center of the valve main body 75, the release member 130 applies load to the valve main body 75 against the biasing force of the coil spring 49 in a direction coincident with the axial center of the valve main body 75.

The rod 133 includes a pair of engaging protrusions 135 protruding radially outward (see FIG. 4 in which only one of the engaging protrusions 135 is shown). The engaging protrusions 135 are positioned to be spaced away from the base 131 (rear surface of the base 131) by a distance corresponding to a thickness of a wall constituting the protruding end of the first protrusion 85 of the bracket 90. The engaging protrusions 135 are formed to diametrically oppose each other with respect to an axis of the rod 133 in correspondence with the cutouts 136 formed on a peripheral portion of the hole 96 (see FIG. 3). When the release member 130 is inserted into the hole 96, the engaging protrusions 135 are positionally aligned with the cutouts 136 to pass therethrough in the depthwise direction 53.

Once inserted into the hole 96, the release member 130 is moved either counterclockwise or clockwise about the axis of the rod 133. The engaging protrusions 135 of the rod 133 are thus displaced such that the engaging protrusions 135 are no longer positionally coincident with the cutouts 136. As a result, the engaging protrusions 135 abut against the peripheral portion of the hole 96, thereby maintaining the release member 130 inserted in the hole 96 against a reaction force from the valve 48, i.e., the biasing force of the coil spring 49. The release member 130 has been assembled to the bracket 90 in this way, as shown FIG. 2. At this time, the handling rib 132 protrudes from the front wall 140 of the bracket 90 outward (frontward), i.e., in a direction the same as that in which the ink supply portion 34 protrudes.

4. How to Realize Air Communication in the Ink Cartridge

In an unused state of the ink cartridge 30, the ink chamber 36 is maintained at a negative pressure. The release member 130 assembled to the bracket 90 (see FIG. 2) pushes the valve 48 to be maintained at its first position against the biasing force of the coil spring 49, thereby causing the protruding portion 92 of the sealing member 76 to be in intimate contact with the inner peripheral wall 129 defining the communication hole 44 in the partition wall 121 to close the communication hole 44, as shown in FIG. 7. The ink chamber 36 is isolated from outside and ink leakage from the ink chamber 36 is prevented. Hence, ink is prevented from reaching (and thus adhering to) the semipermeable membrane 94 that is positioned closer to outside than the communication hole 44 in the air flow path defined in the air communication portion 120.

Upon use of the ink cartridge 30, a user removes the release member 130 from the bracket 90. More specifically, the user rotates the release member 130 with holding the handling rib 132 such that the engaging protrusions 135 are aligned with the cutouts 136 in the depthwise direction 53. Upon alignment of the engaging protrusions 135 with the cutouts 136 in the depthwise direction 53, since the rod 133 of the release member 130 is applied with the biasing force of the coil spring 49, the rod 133 is pushed outward (frontward) due to the biasing force of the coil spring 49.

As shown in FIG. 8, as the rod 133 is coming out of the hole 96, the valve 48 moves from the first position to the second position. When the valve 48 has moved from the first position to the second position, the protruding portion 92 of the sealing member 76 is separated from the inner peripheral wall 129 to open the communication hole 44. As a result, the ink chamber 36 is brought into communication with atmosphere through the communication hole 44, the valve chamber 32 (first chamber), the air passage 77, the valve chamber 32 (second chamber), the through-hole 122, the labyrinth path 124, and the air communication port 125. The ink chamber 36 is thus brought into atmospheric pressure.

5. How Ink Flows if the Ink Cartridge is Placed in a Posture Other than its Upstanding Posture Since the ink cartridge 30 has the width smaller than its height and depth, a user is likely to hold the ink cartridge 30 with its side surfaces being nipped with his fingers. However, while holding the ink cartridge 30 in this way, the user may turn the ink cartridge 30 into a posture other than the upstanding posture shown in FIG. 2. Further, since the side surfaces have the largest area among the surfaces constituting the outer contour of the ink cartridge 30, possibly, the ink cartridge 30 may be placed on a plane with one of its side surfaces facing downward.

Hereinafter, how ink flows based on postures of the ink cartridge 30 will be explained. Also hereinafter, it is assumed that the user holds the ink cartridge 30 just prior to use, and therefore the valve 48 is in the second position and the communication hole 44 is opened.

Figure 11:
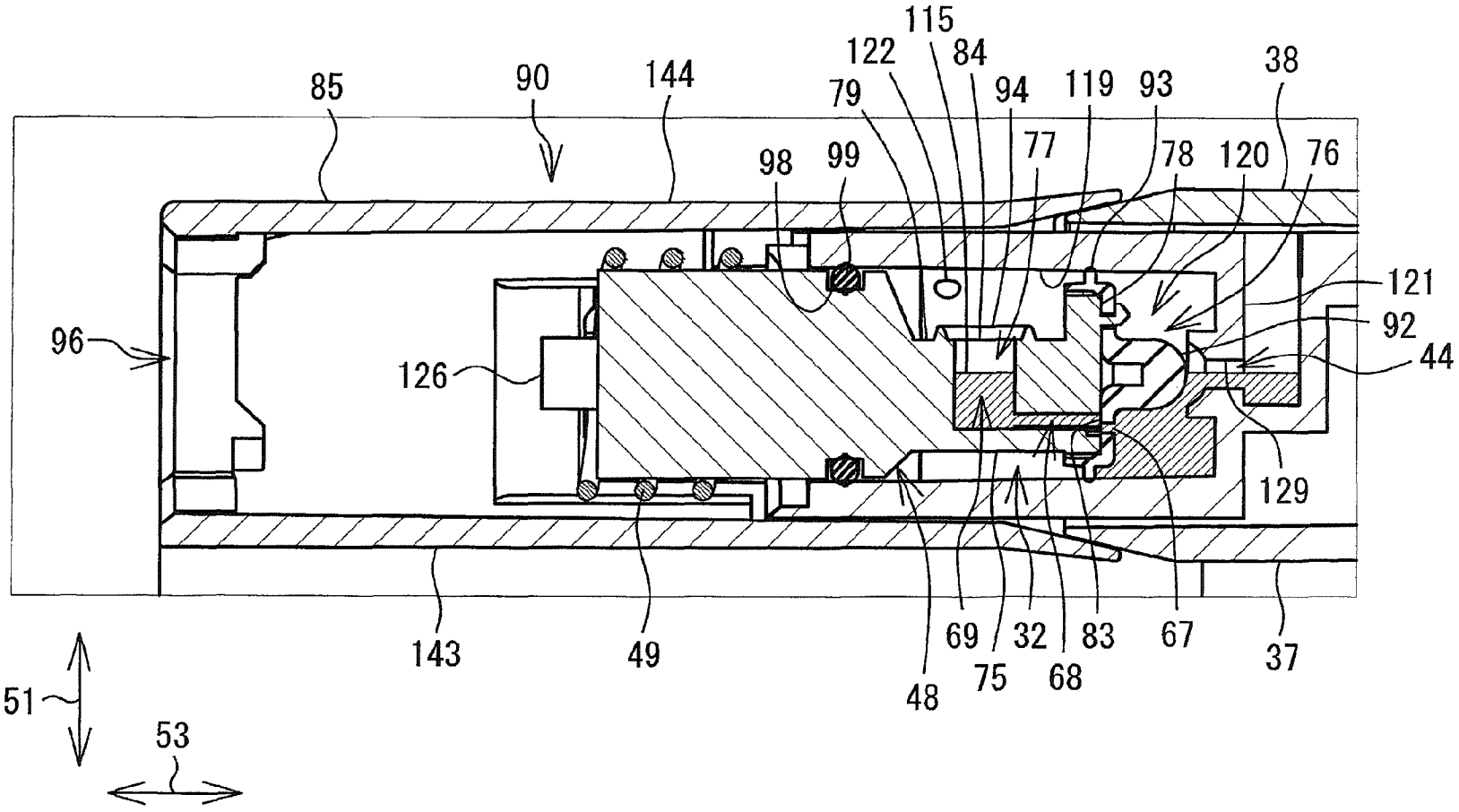
FIG. 11 is an enlarged cross-sectional view showing an area within and in the vicinity of the valve chamber when the ink cartridge according to the embodiment is placed with its left side surface facing downward.

FIG. 11 illustrates a state of the air communication portion 120 (within the valve chamber 32), assuming that the ink cartridge 30 is placed on a plane with the side wall 37 of the cartridge body 31 and the side wall 143 of the bracket 90 facing downward. In FIG. 11, a surface of the ink flowing out of the ink chamber 36 is labeled as an ink surface 115.

The ink in the ink chamber 36 may flow into the valve chamber 32 (first chamber) via the communication hole 44, when the ink surface 115 reaches the communication hole 44 or higher. Since the valve 48 is at the second position, the cap portion 65 of the sealing member 76 is separated from the partition wall 121 in the depthwise direction 53. The ink flowing through the communication hole 44 accumulates in the first chamber of the valve chamber 32. The through-hole 67 of the sealing member 76 and the first opening 83 of the valve main body 75 are positioned lower than the communication hole 44 in the widthwise direction 51, but are positioned higher than (away from) a bottom surface of the valve chamber 32 in the widthwise direction 51 (which now corresponds to the vertical direction), as shown in FIG. 11. Note that the through-hole 67 and the first opening 83 are respectively not positioned on the outermost ends of the cap portion 65 and of the end face 78. Hence, ink flowing into the first chamber will not immediately reach and flow into the through-hole 67 and the first opening 83.

If the ink continues to flow into the first chamber, the ink surface 115 rises and the ink starts to flow into the air passage 77 through the through-hole 67 and the first opening 83. The ink flowing into the air passage 77 enters into the first passage 68 and then into the second passage 69 having a cross-sectional area S2 larger than the cross-sectional area S1 of the first passage 68. Further, the second opening 84 is positioned higher than the through-hole 67 and the first opening 83 in the widthwise direction 51. The ink surface 115 needs to rise up to the second opening 84 if the ink surface 115 is to reach the semipermeable membrane 94. Hence, even if ink may enter into the air passage 77, the ink does not immediately reach the semipermeable membrane 94.

Figure 12:
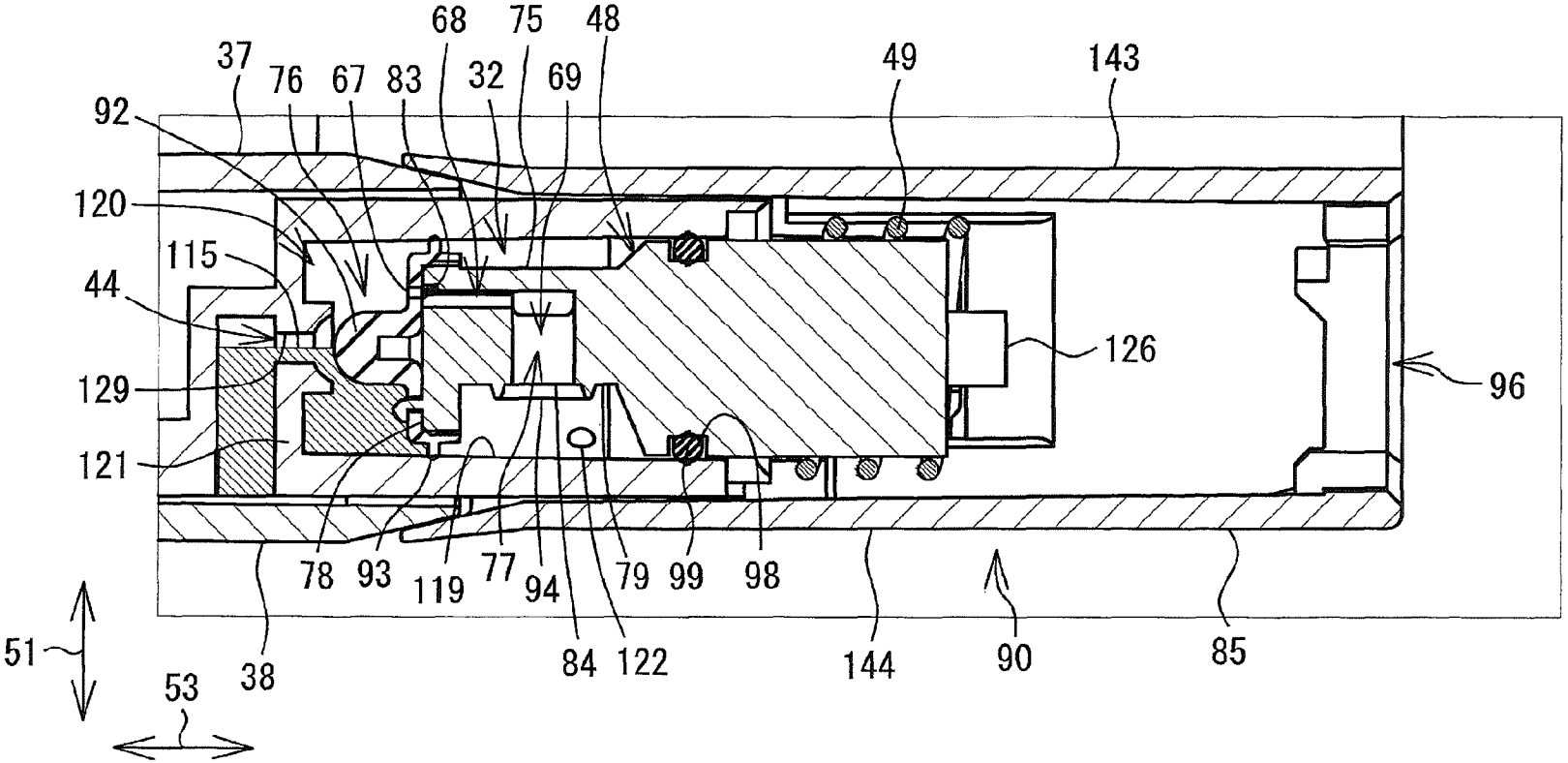
FIG. 12 is an enlarged cross-sectional view showing the area within and in the vicinity of the valve chamber when the ink cartridge according to the embodiment is placed with its right side surface facing downward.

Next, assume that the ink cartridge 30 is placed with the side wall 38 of the cartridge body 31 and the side wall 144 of the bracket 90 facing downward. FIG. 12 illustrates a state of the air communication portion 120 (within the valve chamber 32) at this time.

In this state, the through-hole 67 and the first opening 83 are positioned higher than the communication hole 44 and the second opening 84 in the widthwise direction 51 (which now corresponds to the vertical direction). The ink surface 115 may rise as the ink coming from the ink chamber 36 accumulates in the first chamber of the valve chamber 32. The ink may enter into the air passage 77 when the ink surface 115 reaches the through-hole 67 and the first opening 83. However, since the through-hole 67 and the first opening 83 are positioned higher than the axial center of the valve chamber 32 in the widthwise direction 51, the ink flowing into the first chamber does not immediately enter into the air passage 77 through the through-hole 67 and the first opening 83. The ink is thus hard to reach the semipermeable membrane 94.

Now assume that the ink cartridge 30 is placed with the upper wall 39 of the inner frame 35 and the upper wall 141 of the bracket 90 facing downward (i.e., the ink cartridge 30 is turned upside down).

In this state, since the communication hole 44 is positioned at a lower portion of the ink chamber 36 in the height direction 52, ink flows into the first chamber (valve chamber 32) through the communication hole 44. However, within the valve chamber 32, the communication hole 44 and the first opening 83 (the through-hole 67) are positioned at the same height as each other with respect to the height direction 52. Therefore, ink accumulated in the first chamber does not enter into the air passage 77 until the ink surface 115 rises up to the height of the through-hole 67 and the first opening 83 in the height direction 52. Hence, ink may enter into the valve chamber 32 (first chamber) but is prevented from reaching the semipermeable membrane 94 immediately, even when the ink cartridge 30 is flipped upside down.

6. Operations and Technical Advantages

According to the structure of the present embodiment, the valve 48 is configured to slide within the valve chamber 32 to cause the protruding portion 92 of the sealing member 76 to open and close the communication hole 44. The flange portion 93 of the sealing member 76 is in intimate and sliding contact with the peripheral wall 119 of the valve chamber 32 to realize liquid-tight sealing between the first chamber (communicating with the first opening 83) and the second chamber (communicating with the second opening 84). The valve 48 can become simple and compact, while achieving opening and closing of the air flow path in the air communication portion 120.

Also, the protruding portion 92 is elastically deformable to be in close contact with the inner peripheral wall 129 of the communication hole 44. Hence, contact area between the protruding portion 92 and the inner peripheral wall 129 can be wider than otherwise, thereby realizing reliable sealing of the communication hole 44.

Further, the protruding portion 92 is easy to deform in conformance with an outer shape of the communication hole 44 due to provision of a hollow space inside the protruding portion 92.

Further, the release member 130 is moved to be detached from the bracket 90 when engagement of the release member 130 with the bracket 90 is released. In accordance with the detachment movement of the release member 130, the valve 48 is moved move from the first position to the second position due to the biasing force of the coil spring 49. As a result, the ink chamber 36 is permitted to communicate with atmosphere through the communication hole 44 that is opened by the valve 48 moved to the second position. According to this structure of the present embodiment, the movement of the valve 48 attributed to removal of the release member 130 is achieved solely by the biasing force of the coil spring 49. Since there is no need for the user to resist the biasing force of the coil spring 49, the user can feel little load for achieving communication of the ink chamber 36 with atmosphere.

Significance of the structure of the present embodiment can be demonstrated clearly when compared to a conventional valve structure in which a valve body is biased by a biasing member in a direction to close an air communication port (see Japanese Patent Application Publication No. 2009-96126, for example). In this type of conventional valve structure, in order to open the air communication port, a user is required to apply a force to move the valve body against a biasing force of the biasing member during mounting of the ink cartridge. Hence, conceivably, user's workload required during mounting of the ink cartridge is not slight. This hold true not only for a conventional valve structure in which a user needs to apply force against the biasing force of the biasing member to the open the air communication port before mounting the ink cartridge, but also for other conventional technique other than valve structure to open the air communication port: for example, a structure in which a user needs to break a seal closing the air communication port. In any of these conventional techniques, user's workload could be heavy. In contrast, the structure of the present embodiment can reduce such burden for a user to open the communication hole 44 in order to realize communication between the ink chamber 36 and outside of the ink cartridge 30, since there is no need for a user to apply force against the biasing force of the coil spring 49.

According to another aspect of the ink cartridge 30 according to the depicted embodiment, the semipermeable membrane 94 is attached to the valve main body 75 of the valve 48 to close the air passage 77, and the labyrinth path 124 is formed in the inner frame 35. With this structure, even if ink may flow into the valve chamber 32 through the communication hole 44 for some reason, for example, by user's turning the ink cartridge 30 upside down, the ink is suppressed from flowing out of the inner frame 35.

Further, the semipermeable membrane 94 is attached to the valve main body 75 of the valve 48, not attached to the peripheral wall 119 of the valve chamber 32. This means that, the semipermeable membrane 94 can be attached to the valve main body 75 in a state where the valve main body 75 is removed from the valve chamber 32. Therefore, providing (attaching) the semipermeable membrane 94 in the air flow path formed in the air communication portion 120 is realized with ease and assembly of the ink cartridge 30 can be facilitated, compared to a case in which the semipermeable membrane 94 is attached to somewhere within the valve chamber 32.

Providing a semipermeable membrane in an air flow path is a conventional art used to seal the air flow path formed in the ink cartridge (see Japanese Patent Application Publication Nos. 2010-221477 and 2012-152998, for example). However, the semipermeable membrane cannot ensure its prescribed air communication performance when exposed to ink, since contact with ink could cause ink meniscus to be formed in minute holes of the semipermeable membrane and result in increase in resistance for air to pass the semipermeable membrane.

User's unintended handling of the ink cartridge (for example, a user may temporarily place the ink cartridge in an orientation other than the upstanding posture before mounting the ink cartridge into an accommodating section or when unpacking a new ink cartridge) could cause ink to flow out from the ink chamber into the air flow path, possibly resulting in contact of the ink with the semipermeable membrane. However, according to the depicted structure of the ink cartridge 30 of the present embodiment, even if the ink cartridge 30 is held or placed in an orientation other than the upstanding posture, the ink flowing into the valve chamber 32 from the ink chamber 36 via the communication hole 44 does not reach the semipermeable membrane 94 immediately.

Furthermore, the second passage 69 has the larger cross-sectional area S2 than the cross-sectional area S1 of the first passage 68 with respect to the direction perpendicular to the direction of air flow in the air passage 77. Therefore, this structure makes it harder for the ink entering into the second passage 69 from the first passage 68 to immediately reach the semipermeable membrane 94.

Still further, the communication hole 44 and the first opening 83 are positioned vertically at the same height as each other in the height direction 52. Hence, although ink may flow into the valve chamber 32 (first chamber) when the ink cartridge 30 is in the upstanding posture or in a state where the ink cartridge 30 is flipped upside down, the ink does not enter into the air passage 77 until the ink surface 115 within the first chamber rises up to the same height as the through-hole 67 and the first opening 83 in the height direction 52. This construction is effective in suppressing the ink accumulated in the first chamber from reaching the semipermeable membrane 94.

Still further, since the first opening 83 is positioned to be spaced away from the communication hole 44 in the depthwise direction 53 when the valve 48 is at the second position, the space is formed between the flange portion 93 and the partition wall 121 (first chamber). This space (first chamber) can serve as the ink buffer chamber to prevent ink accumulated therein from immediately reaching the semipermeable membrane 94.

Still further, the communication hole 44 is formed in the center of the partition wall 121 in the widthwise direction 51 in the present embodiment. With this structure, ink in the ink chamber 36 is prevented from flowing into the valve chamber 32 through the communication hole 44 even if the ink cartridge 30 is held or placed with one of the side surfaces facing downward, as long as the ink surface within the ink chamber 36 is below the communication hole 44.

Yet further, the first opening 83, the second opening 84 and the air passage 77 are formed in the valve 48, and the communication hole 44 is closed by the valve 48 in the first position. With this structure, ink is prevented from entering into the valve chamber 32 as long as the valve 48 is in the first position.

According to still another aspect, when the release member 130 is assembled to the bracket 90, the handling rib 132 of the release member 130 protrudes from the front wall 140 of the bracket 90 in a direction the same as the direction in which the ink supply portion 34 protrudes (in the loading direction 56). With this structure, if the user attempts to insert the ink cartridge 30 into the cartridge accommodating section 110 without removing the release member 130 from the bracket 90, the release member 130 interferes with the cartridge accommodating section 110 and prevents the ink needle 113 from entering into the ink supply portion 34. That is, the ink cartridge 30 cannot be loaded in the cartridge accommodating section 110 without removing the release member 130 in advance. This configuration can reliably prevent wrong installation of the ink cartridge 30 into the cartridge accommodating section 110.

In the ink cartridge 30 of the present embodiment, the sealing member 76 and a part of the air flow path (air passage 77, first and second chambers) are provided within the valve chamber 32. Space within and in the vicinity of the valve chamber 32 is therefore effectively utilized.

Although a part of the air flow path (air passage 77) is formed in the valve 48 in the depicted embodiment, the air flow path in entirety may be formed in the inner frame 35 if the valve 48 is not employed in the ink cartridge 30.

Specifically, for example, a chamber that constitutes a part of the air flow path is formed in the inner frame 35 and a foam may be disposed within the chamber to absorb ink. In this case, the chamber filled with the foam is in communication with the labyrinth path 124 at a position closer to the ink chamber 36 than the labyrinth path 124 to the ink chamber 36 in the air flow path. Alternatively, a semipermeable membrane for closing the air flow path may be directly attached to the inner frame 35 at a position closer to the ink chamber 36 than the labyrinth path 124 to the ink chamber 36 in the air flow path. With these structures without the valve 48, communication between the ink chamber 36 and ambient air can be achieved, while ink leakage can be prevented.

While the invention has been described in detail with reference to the specific embodiment thereof, it would be apparent to those skilled in the art that various changes and modifications may be made therein without departing from the scope of the invention.

What is claimed is:

1. A liquid cartridge comprising:

a cartridge body defining a liquid chamber therein for storing liquid;

a liquid supply portion provided at the cartridge body and configured to supply the liquid stored in the liquid chamber to outside;

an air flow path provided in the cartridge body, the air flow path configured to be in communication with the liquid chamber through a communication hole and in communication with ambient air to permit the liquid chamber to communicate with ambient air through the air flow path, the air flow path having an inner peripheral wall defining an internal space therein; and a valve configured to open and close the air flow path and comprising:

a valve main body disposed in the internal space and slidable in a sliding direction; and a sealing member provided on the valve main body, the sealing member including a first elastic portion configured to seal the communication hole and a second elastic portion configured to be in sliding contact with the inner peripheral wall.

2. The liquid cartridge as claimed in claim 1, wherein the valve main body is formed with a first opening, a second opening and an air passage connecting the first opening and the second opening inside the valve main body to permit air flow between the first opening and the second opening.

3. The liquid cartridge as claimed in claim 1, wherein the second elastic portion is configured to partition the internal space into a first chamber in communication with the first opening and a second chamber in communication with the second opening, the second elastic portion being configured to prevent liquid flow between the first chamber and the second chamber.

4. The liquid cartridge as claimed in claim 1, wherein the communication hole is defined by a peripheral wall; and wherein the first elastic portion is formed as a protrusion protruding in a direction parallel to the sliding direction and is configured to contact the peripheral wall to close the communication hole.

5. The liquid cartridge as claimed in claim 4, wherein the first elastic portion defines a hollow space therein.

6. The liquid cartridge as claimed in claim 1, wherein the sealing member is cap-like shaped to cover one end of the valve main body in the sliding direction.

7. The liquid cartridge as claimed in claim 6, wherein the sealing member is formed with a through-hole in communication with the first opening of the valve main body.

8. The liquid cartridge as claimed in claim 1, wherein the valve further comprises a semipermeable membrane covering one of the first opening and the second opening of the valve main body; and wherein remaining one of the first opening and the second opening is in communication with the communication hole.

9. The liquid cartridge as claimed in claim 1, wherein the valve is slidable in the sliding direction between a first position at which the first elastic portion seals the communication hole and a second position at which the first elastic portion opens the communication hole, the liquid cartridge further comprising:

a biasing member configured to apply a biasing force to the valve toward the second position; and a release member configured to be engaged with the cartridge body, the release member engaged with the cartridge body maintaining the valve at the first position against the biasing force of the biasing member, the release member disengaged from the cartridge body moving in a direction of the biasing force of the biasing member.

10. The liquid cartridge as claimed in claim 9, further comprising:

a semipermeable membrane provided on the valve to close an air passage; and a labyrinth path disposed in the air flow path and in communication with ambient air, wherein the internal space of the air flow path comprises a valve chamber configured to movably accommodate the valve therein, the valve chamber having one end in communication with the liquid chamber via the communication hole and another end in communication with ambient air via the labyrinth path; and wherein the second elastic portion seals the valve chamber such that a first chamber and a second chamber are communicable through the air passage.

11. The liquid cartridge as claimed in claim 9, wherein the liquid supply portion is provided on a particular surface of the cartridge body; and wherein the release member engaged with the cartridge body protrudes from the particular surface of the cartridge body.

12. The liquid cartridge as claimed in claim 1, wherein an air passage is in communication with a first chamber via the first opening and extends in at least one of a first direction and a second direction perpendicular to the first direction, a second chamber being in communication with the air passage via the second opening.

13. The liquid cartridge as claimed in claim 12, wherein the first chamber is in communication with the communication hole and serves as a buffer chamber, the first opening being positioned offset from outermost ends of the valve main body in the first direction, the first opening and the second opening being positioned at sides opposite to each other with respect to a center of the valve main body in the first direction, the second opening being covered with a semipermeable membrane.

14. The liquid cartridge as claimed in claim 12, wherein the cartridge body comprises a plurality of walls including: a first wall and a second wall opposing each other in the first direction; and a third wall extending in the first direction and a third direction perpendicular to the first direction and the second direction, at least one of the first and second walls having a largest area among the plurality of walls constituting the cartridge body.

15. The liquid cartridge as claimed in claim 14, wherein the liquid supply portion is provided on the third wall to be oriented in the second direction.

16. The liquid cartridge as claimed in claim 12, wherein air flows through the air passage in an air flow direction; and wherein the air passage comprises a first portion extending in the second direction and in communication with the first opening, and a second portion extending from the first portion in the first direction and in communication with the second opening, the second portion having a cross-sectional area larger than a cross-sectional area of the first portion in a direction perpendicular to the air flow direction.

17. The liquid cartridge as claimed in claim 14, wherein the communication hole and the first opening are positioned at a same height as each other in the third direction.

18. The liquid cartridge as claimed in claim 12, wherein the valve is slidable in the sliding direction between a first position at which the first elastic portion seals the communication hole and a second position at which the first elastic portion opens the communication hole, and wherein the communication hole and the first opening of the valve in the second position define a distance therebetween in the second direction.

19. The liquid cartridge as claimed in claim 12, wherein the communication hole is formed in a partition wall defining a portion of the liquid chamber, the communication hole being positioned in a center of the partition wall in the first direction.

* * * * *